US007226354B2

(12) United States Patent
Kawano et al.

(10) Patent No.: US 7,226,354 B2
(45) Date of Patent: Jun. 5, 2007

(54) STORAGE BODY WITH AIR CLEANING FUNCTION

(75) Inventors: Tomoyuki Kawano, Kumamoto (JP); Toshihiro Higashi, Kumamoto (JP); Hiroaki Koba, Kumamoto (JP); Ichiro Ikenaga, Kumamoto (JP); Kazuya Tokunaga, Kumamoto (JP); Satoru Yoshimitsu, Kumamoto (JP); Hitoshi Shibuya, Kumamoto (JP)

(73) Assignee: Kongo Kabushiki Kaisha, Kumamoto (JP)

( * ) Notice: Subject to any disclaimer, the term of this patent is extended or adjusted under 35 U.S.C. 154(b) by 661 days.

(21) Appl. No.: 10/416,425

(22) PCT Filed: May 29, 2002

(86) PCT No.: PCT/JP02/05184

§ 371 (c)(1),
(2), (4) Date: May 8, 2003

(87) PCT Pub. No.: WO02/098766

PCT Pub. Date: Dec. 12, 2002

(65) Prior Publication Data

US 2004/0038641 A1 Feb. 26, 2004

(30) Foreign Application Priority Data

May 30, 2001 (JP) ..... 2001-161559

(51) Int. Cl.
*F24F 7/00* (2006.01)

(52) U.S. Cl. ..... 454/193; 55/385.2; 454/189

(58) Field of Classification Search ..... 454/188, 454/189, 191, 193, 56, 57; 55/385.2
See application file for complete search history.

(56) References Cited

U.S. PATENT DOCUMENTS

| | | | | | |
|---|---|---|---|---|---|
| 3,063,256 | A | * | 11/1962 | Lamb | 62/256 |
| 3,115,019 | A | * | 12/1963 | Rutishauser | 62/256 |
| 3,397,631 | A | * | 8/1968 | Simons | 454/190 |
| 4,299,092 | A | * | 11/1981 | Ibrahim | 62/81 |
| 4,927,438 | A | * | 5/1990 | Mears et al. | 55/385.2 |
| 5,425,793 | A | * | 6/1995 | Mori et al. | 55/385.2 |

FOREIGN PATENT DOCUMENTS

| | | |
|---|---|---|
| JP | 63-93643 | 4/1988 |
| JP | 1-288342 | 11/1989 |
| JP | 4-285503 | 10/1992 |
| JP | 11-241880 | 9/1999 |
| JP | 11-311469 | 11/1999 |

OTHER PUBLICATIONS

Translated Japanese International Search Report.

* cited by examiner

*Primary Examiner*—Harold Joyce
(74) *Attorney, Agent, or Firm*—Ernest A. Beutler

(57) ABSTRACT

A cabinet wherein air sucked from an inlet opening 4*d* of a shelf board combined inlet duct 4 by drive of an air purification unit 3 is passed through the shelf board combined inlet duct 4 and introduced into the inside of a case 3*a*, and by a dust collection filter 32 and an odor eliminating means 33. Air forced into the shelf board combined outlet duct 5 through the air duct 10 is exhausted through an outlet opening 5*d* of the shelf board combined outlet duct 5, and air curtain is formed along the opening of the storage section 11 of a cabinet 1. Therefore, air in the storage section 11 of the cabinet 1 is circulated and purified, while getting caught in a circulating airflow including the air curtain.

11 Claims, 29 Drawing Sheets

(8 of 29 Drawing Sheet(s) Filed in Color)

FIG. 28A
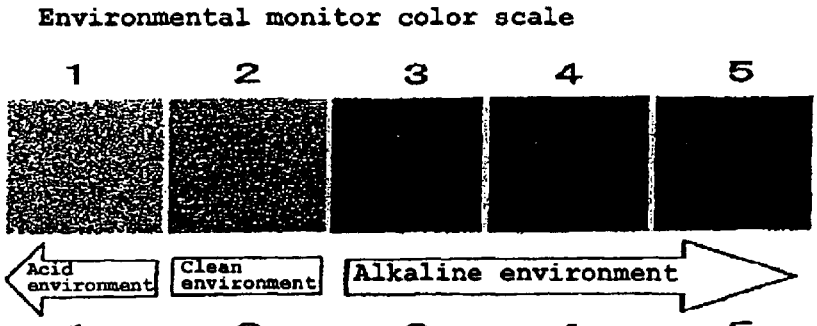
FIG. 28B
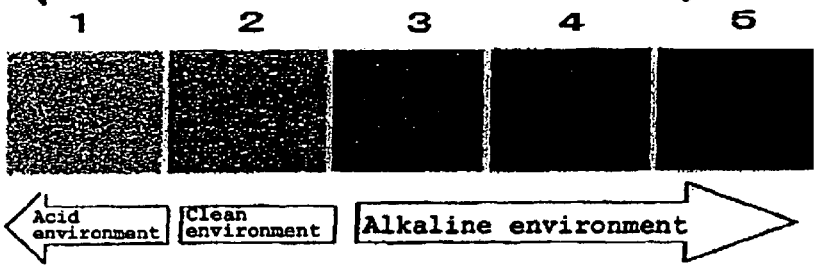
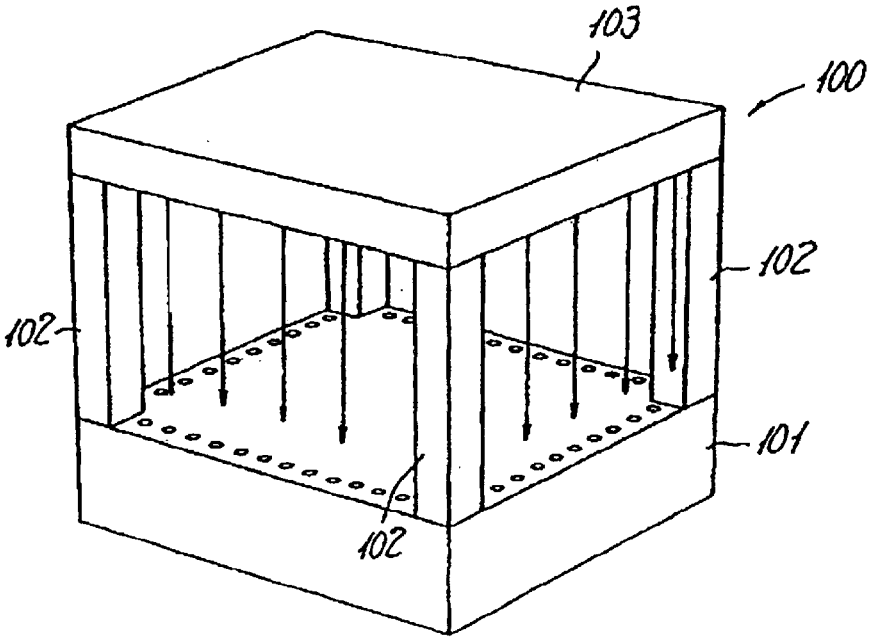
FIG. 29

STORAGE BODY WITH AIR CLEANING FUNCTION

FIELD OF THE INVENTION

The present invention relates to storages such as a movable shelf, a fixed shelf, a cabinet, a showcase, a closet, a shoe box, and a storeroom and more particularly to storage with air purification function having a storage section for storing objects and an opening for taking the stored object in and out as well as comprising a function for purify the air within the storage section of the storage.

BACKGROUND ART

Storages such as the movable shelf, the fixed shelf, the cabinet, the showcase, the closet, the shoe box, and the storeroom described above are widely used in libraries, cultural properties depositories, archives, museums, storerooms, warehouses, hospitals, basement storages, art museums, shops, department stores, supermarkets, public rest rooms, and the like.

As the storage described above, it is well known that there is an open type storage having a structure that the opening of the storage section for at least taking the stored object in and out is always opened or a closed type storage having a structure that a door for opening and closing the opening is disposed.

However, the open type storage does not have the door, compared to the closed type storage, so that the extra space for opening and closing the door is not necessary, and the door does not interfere with taking the stored object in and out. On the other hand, through the opening of the storage section normally opened, particles such as fungus spores, bacterium, pollen, dusts, and dead bodies of ticks floating in the air, and harmful insects such as moths and spiders easily invade in the storage section.

While the closed type storage described above can prevent the invasion of the particles, harmful insects, or the like described above from the opening of the storage section by closing the door to some extent, even in the storage, it is difficult to prevent the invasion of the particles, harmful insects, or the like described above into the storage section at opening and closing of the door or taking the stored object in and out.

Furthermore, the closed type storage shuts out the exchange of the air in the storage section and fresh air by closing the door, so that the air in the storage section is easily polluted.

Therefore, the conventional type of storages have problems that, by the effect of particles or harmful insects invaded through the opening of the storage section or polluted air in the storage section, the quality of the stored object in the storage section is reduced, and furthermore, air or the stored object in the storage section produces bad smell.

The object of the present invention is to provide storage with air purification function that can prevent the invasion of particles, harmful insects, or the like from the opening of the storage section and pollution of air in the storage section.

Another object of the present invention is to provide storage with air purification function that can purify the air in and around the storage.

DISCLOSURE OF THE INVENTION

A first feature of the invention is adapted to be embodied in a storage with air purification function, having: a storage section for storing a stored object; and an opening for taking the stored object in and out; comprising: an inlet path including an inlet opening for sucking air in the storage section; an outlet path including an outlet opening for exhausting air introduced in the inlet path from the inlet opening; an air circulating means for circulating air in the storage section through the inlet path and the outlet path; and an air filter for purifying air in the storage section circulated with the air circulating means, wherein the outlet opening is formed such that air flows along the opening. In the storage with air purification function, air in the storage section introduced from the inlet opening in the inlet path by the air circulating means is purified with the air filter. The air purified with the air filter is exhausted through the outlet path from the outlet opening along the open side of the opening of the storage. Therefore, along the opening of the storage, the air curtain including the airflow purified with the air filter is formed. In other words, the storage with air purification function purifies the air in the storage section of the storage by collecting particles such as fungus spores, bacterium, pollen, dusts, and dead bodies of ticks floating in the air with the air filter. Furthermore, the storage with air purification function blocks the invasion of harmful insects such as moths and spiders into the storage section with the air curtain.

Another feature of the invention is the inclusion in the preceding feature wherein the opening is formed in the front of the storage, and, the outlet opening of the outlet path is formed in an air duct disposed in the opening.

In the storage with air purification function, air purified with the air filter is exhausted from the outlet opening formed in the air duct. Since the air duct is disposed in the opening, air exhausted from the outlet opening flows to cover the opening formed in the front of the storage. Therefore, the air curtain including the airflow purified with the air filter is certainly formed along the opening of the storage.

Still another feature of the invention is the provision in the aforedescribed two features wherein circulating speed of air circulated by the air, circulating means is set to 0.5 m/sec or less.

Generally, it is said that when circulating speed of air circulated by the air circulating means becomes 0.5 m/sec or faster, the stored object could be deteriorated or weathered from wind damage, depending on the stored object stored in the storage section of the storage. Therefore, in the storage with air purification function, circulating speed of air circulated by the air circulating means is set to 0.5 m/sec or less.

Another feature of the invention that can be utilized with the aforementioned features is the provision of an upper board forming the top of the storage, section of the storage is formed in a hollow shape, and the upper board serves as the air duct forming the inlet path or the outlet path.

In the storage with air purification function, the upper board forming the top of the storage section of the storage is formed in a hollow shape, and the upper board serves as the air duct forming the inlet path or the outlet path, so that configuration of the storage can be simplified, and reducing the cost of the storage can be accomplished.

A still further feature of the invention that can be utilized with the aforementioned features is the provision of a lower board forming the bottom of the, storage section of the storage is formed in a hollow shape, and the lower board serves as the air duct forming the inlet path or the outlet path.

In the storage with air purification function, the lower board forming the bottom of the storage section of the storage is formed in a hollow shape, and the lower board serves as the air duct forming the inlet path or the outlet path, so that configuration of the storage can be simplified, and reducing the cost of the storage can be accomplished. Furthermore, the air flowing to cover the open side of the opening formed in the side of the storage and forming the air curtain is sucked into the lower board forming the lower part of the storage section or exhausted from the lower board, so that the opening of the storage section of the storage is certainly covered by the air curtain.

A still further feature of the invention that can be utilized with the aforementioned features is that the storage comprises a plurality of, supports disposed in the vertical direction along the side of the storage section, and the air duct forming the inlet path or the outlet path is disposed between the supports.

In the storage with air purification function, since the air duct forming the inlet path or the outlet path is disposed between plurality of supports disposed in the vertical direction along the side of the storage section, the air duct can be disposed by using a dead space in the storage.

A still further feature of the invention that can be utilized with the aforementioned features is that the storage comprises a plurality of, supports disposed in the vertical direction along the side of the storage section and formed in a hollow shape, and the supports serve as the air duct forming the inlet path or the outlet path.

In the storage with air purification function, since the plurality of supports disposed in the vertical direction along the side of the storage section and formed in a hollow shape serve as the air duct forming the inlet path or the outlet path, the air duct can be disposed by using a dead space in the storage, as well as the configuration of the storage can be simplified, and reducing the cost of the storage can be accomplished.

A still further feature of the invention that can be utilized with the aforementioned features is that the storage comprises a side board forming the side of the storage section and formed in a hollow shape, and the side board serves as the air duct forming the inlet path or the outlet path.

In the storage with air purification function, since the side board forming the side of the storage section and formed in a hollow shape serves as the air duct forming the inlet path or the outlet path, the air duct can be disposed by using a dead space in the storage, as well as the configuration of the storage can be simplified, and reducing the cost of the storage can be accomplished.

A still further feature of the invention that can be utilized with the aforementioned features is that the storage comprises a shelf, board placing the stored object, and the shelf board comprises an air duct, an outlet opening for exhausting air from the air duct in the horizontal direction, an inner surface for temporarily blocking the air flow exhausted from the outlet opening, and a second outlet opening for exhausting the air blocked at the inner surface downward.

The air flow exhausted from the outlet opening is blocked with the inner surface of the shelf board, reduced its speed, and exhausted from the second outlet opening, so that the wind damage is reduced even if the air flow hits the stored object. Furthermore, because air flow exhausted from the second outlet opening is angularly downwardly exhausted toward the outside of the storage, displacement striking the stored object is reduced, so that wind damage is reduced in terms of the above. A still further feature of the invention that can be utilized with the aforementioned features is that the storage is comprised of plurality of cabinets disposed such that the back side of the storage section is placed in back to back with a predetermined gap, and the air duct forming the inlet path or the outlet path is disposed in the gap between the back side placed in back to back.

In the storage with air purification function, since the air duct forming the inlet path or the outlet path is disposed in the gap on the back side of the plurality of cabinets disposed such that the back side of the storage section is placed in back to back with a predetermined gap, the air duct can be disposed by using a dead space in the storage, and the air duct can also be mounted to the existing storage without disassembly or major alteration of the storage.

Another feature of the invention that can be used with the other described features is the inclusion of an odor eliminating device.

In the storage with air purification function, an odor of the air in the storage section is removed by the odor eliminating means, so that pollution of air in the storage section can be prevented.

Another feature of the present invention is the provision of a storage with air purification, function, having: a storage section for storing a stored object; and an opening for taking the stored object in and out; comprising: an inlet path for sucking air in the storage section; an outlet path for exhausting air introduced in the inlet path; and an air purification means for circulating and purifying air in the storage section through the inlet path and the outlet path; wherein the air purification means is placed in proximity to the side board, as well as the inlet path is communicated with the interior space of the side board, and the outlet opening is formed such that air flows along the opening.

A further feature of the invention can be employed with the feature described in the immediately preceding paragraph wherein a gap between the storage body and the side, board is an inlet opening communicating with the inlet path.

A further feature of the invention can be employed in the feature of the second preceding paragraph wherein the air purification means comprises an, inlet section and an outlet section, and an outlet path and a duct are integrated in the outlet section.

The feature described in the preceding paragraph can also be used where the duct used as a shelf board, the outlet, path is directly connected to the shelf board, and the outlet opening is formed in the shelf board.

The feature described in the preceding paragraph can also be used where the shelf board forms the inlet path.

BRIEF DESCRIPTION OF DRAWINGS

The patent file contains at least one drawing executed in color. Copies of this patent with color drawings will be provided by the Office upon request and payment of the necessary fee.

FIG. 28(*a*) is an environmental monitor color scale showing a measurement result of an environmental cleanliness of the self-standing test shelf before the operation of the above air purification unit, and FIG. 28(*b*) is an environmental monitor color scale showing a measurement result of an environmental cleanliness of the self-standing test shelf after the operation of the above air purification unit.

FIG. 29 is a schematic perspective view of an open type display case related to the other embodiment of the present invention.

PREFERRED EMBODIMENT OF THE INVENTION

An embodiment of a cabinet, particularly as a storage for storing books, of the invention will be described hereinafter.

Figure 1:
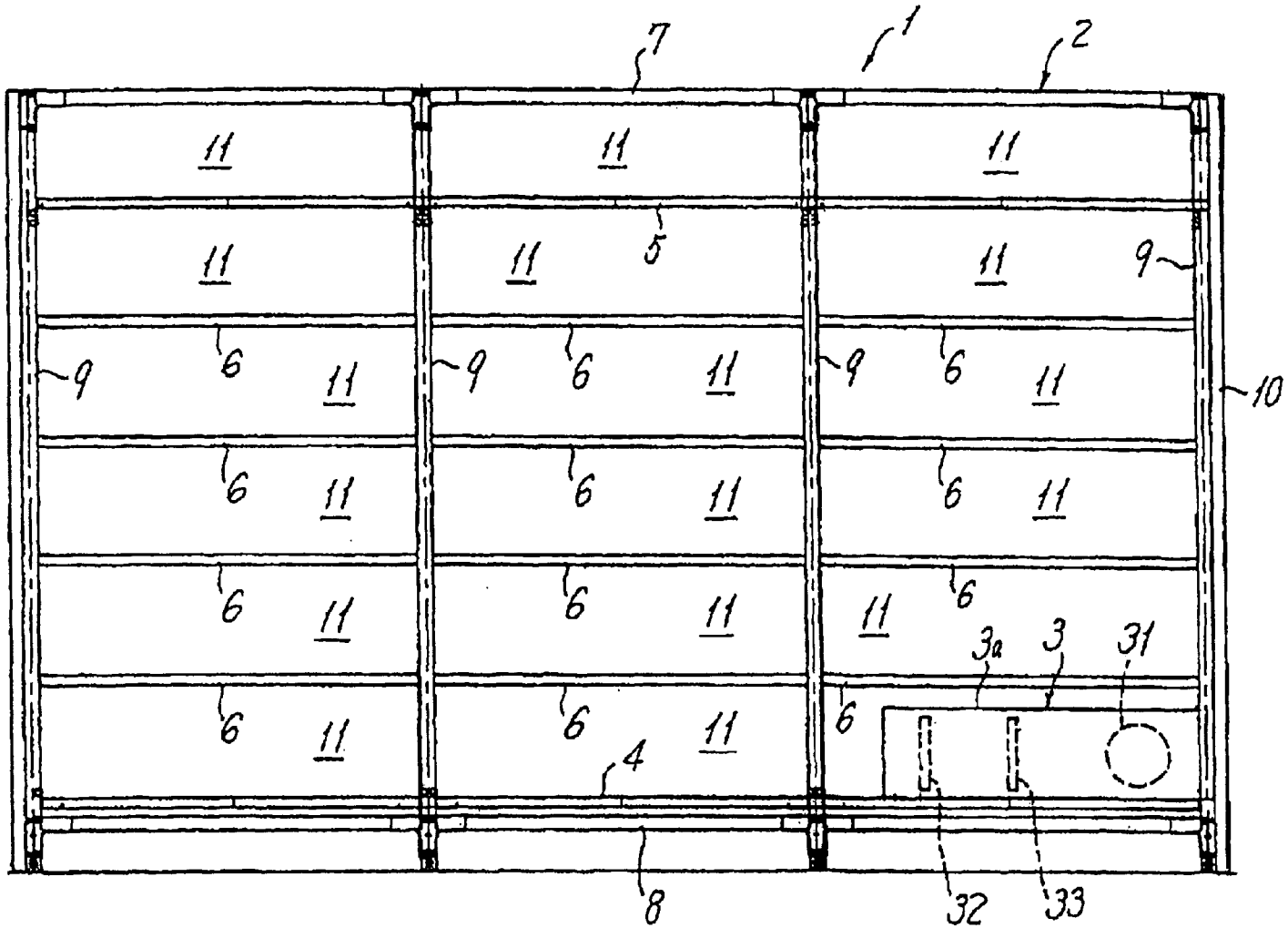
FIG. 1 is a front view of the cabinet related to an embodiment of the present invention.
Figure 2:
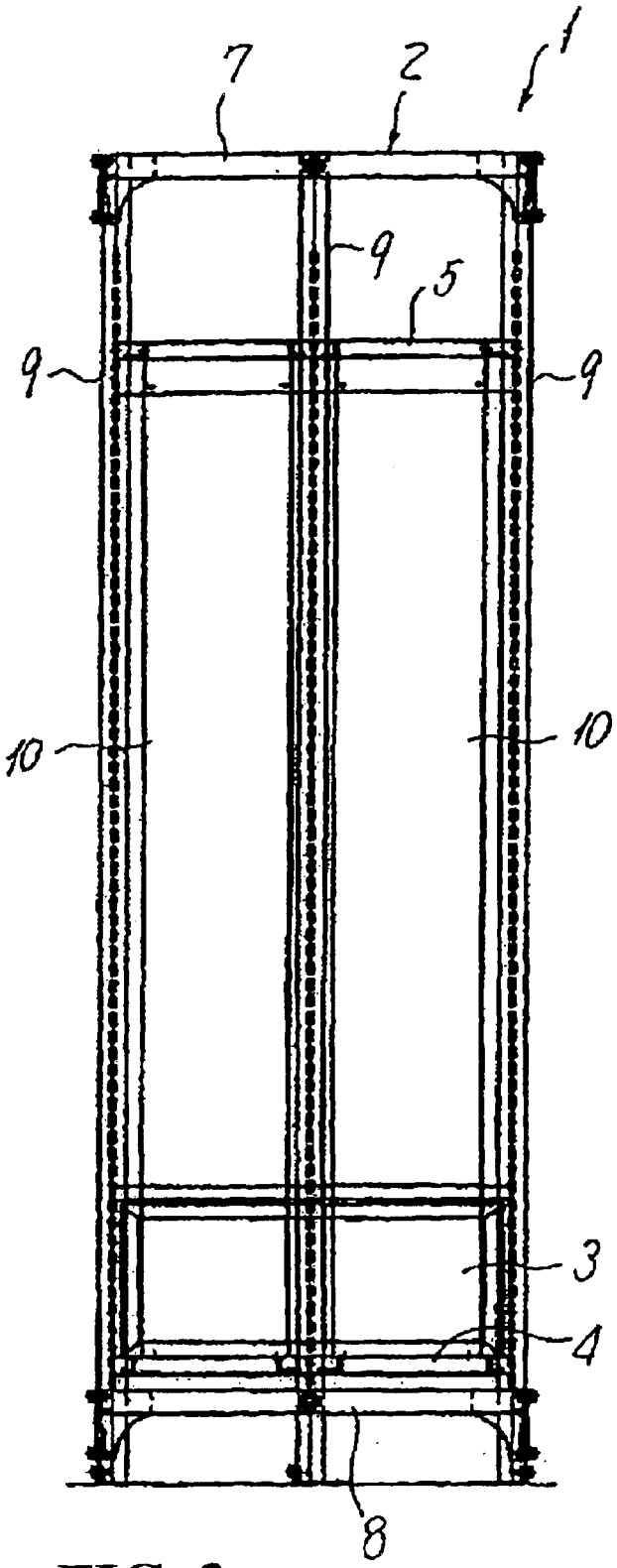
FIG. 2 is a side view of the cabinet related to the above embodiment.

FIG. 1 is a front view of the cabinet 1, and FIG. 2 is a side view of the same. In those figures, the cabinet 1 as a storage with air purification function is comprised of a main body 2 and an air purification unit 3.

The main body 2 is comprised of a shelf board combined inlet duct 4 which serves both as an inlet duct and a shelf board as a lower board forming the lower side of a storage section 11 of the cabinet 1 on which the air purification unit 3 is disposed, a shelf board combined outlet duct 5 which serves both as an outlet duct and a shelf board as an upper board forming the upper side of the storage section 11 of the cabinet 1, plurality of shelf boards 6 on which stored objects such as books are placed, a top board 7 of the cabinet 1, a bottom board 8 of the cabinet 1, plurality of support members 9 for supporting the plurality of shelf boards 6 and the top and bottom boards 7 and 8, and an air duct 10 disposed between the support members 9 on one side of the cabinet 1.

The air purification unit 3 of the cabinet 1 of the embodiment is arranged near the air duct 10 on the shelf board combined inlet duct 4 and mainly comprised of a sirocco fan 31 as an air circulating means, a dust collection filter 32 as an air filter mainly for collecting fine particles such as fungus spores, bacterium, pollen, dust and dead bodies of ticks floating in the air in the storage section 11 of the cabinet 1, an odor eliminating means 33 for eliminating odor in the air in the storage section 11, and a controlling means comprised of a drive circuit and the like (not shown) for controlling the drive of the sirocco fan 31.

Figure 3:
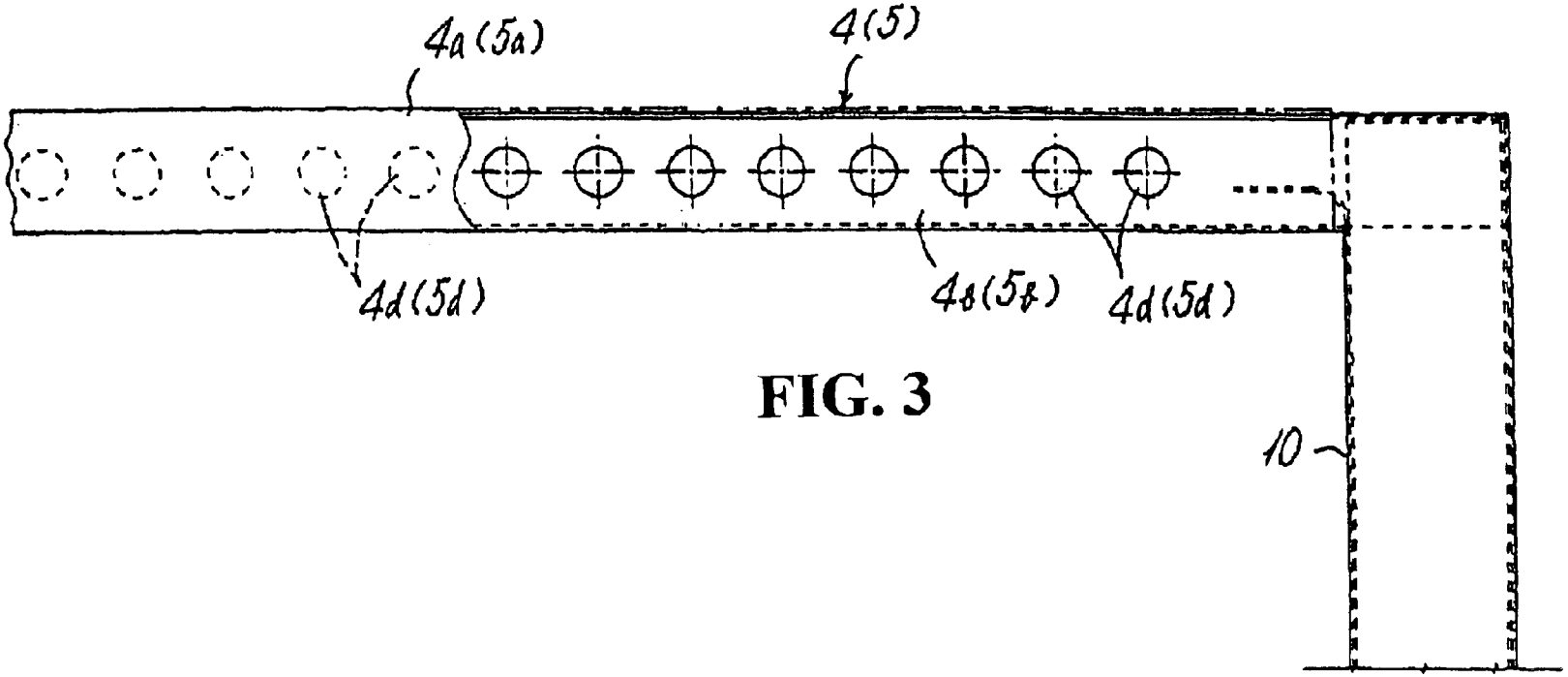
FIG. 3 is a partially sectional front view of a shelf board combined inlet duct and a shelf board combined outlet duct forming a lower board of the storage section viewed from the opening side (front side) of the storage section of the above cabinet.
Figure 4:
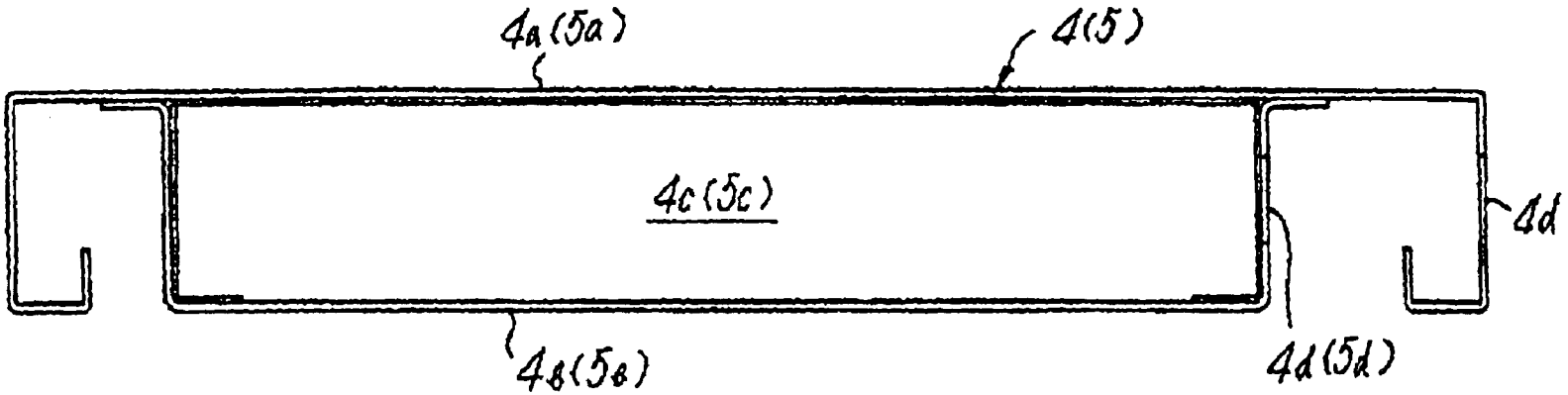
FIG. 4 is a sectional view of the shelf board combined inlet duct and the shelf board combined outlet duct forming the lower board of the storage section of the above cabinet.

FIG. 3 is a partially sectional front view of the shelf board combined inlet duct 4 and the shelf board combined outlet duct 5 viewed from the direction of the opening (front side) of the storage section 11 of the cabinet 1. FIG. 4 is a sectional view of the shelf board combined inlet duct 4 and the shelf board combined outlet duct 5.

As shown in FIG. 3 and FIG. 4, the shelf board combined inlet duct 4 and the shelf board combined outlet duct 5 have approximately the same appearance in shape as that of the shelf boards 6 and are formed with an inlet path 4*c* and an outlet path 5*c*, respectively, of a hollow rectangular shape in section formed by a shelf board material 4*a* (5*a*) and a wide-groove-like reinforcing board 4*b* (5*b*) fixed to the lower side of the shelf board material 4*a* (5*a*).

Further, the shelf board combined inlet duct 4 is formed with a number of inlet ports 4*d* interconnecting to its inlet path 4*c* formed on the front side (right-hand side of FIG. 4) of the shelf board material 4*a* and the reinforcing board 4*b*, respectively, forming the inlet path 4*c*.

On the other hand, the shelf board combined outlet duct 5 is formed with a number of outlet ports 5*d* interconnecting to its outlet path 5*c* formed on the front side (right-hand side of FIG. 4) of the shelf board material 5*a* and the reinforcing board 5*b*, respectively, forming the outlet path 5*c*.

Figure 5:
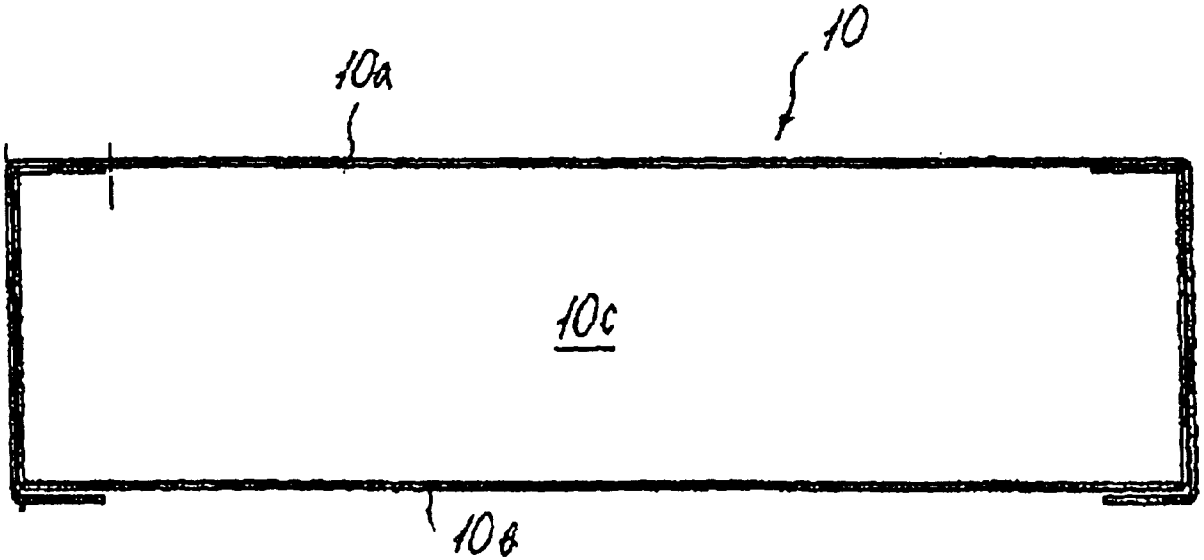
FIG. 5 is a sectional view of an air duct disposed between supports on one side of the above cabinet.

The air duct 10 disposed between the support members 9, as shown in FIG. 5, is constituted by two board materials 10*a* and 10*b* of a channel shape in cross section so as to form a rectangular ventilation path 10*c* in section.

Figure 6A:
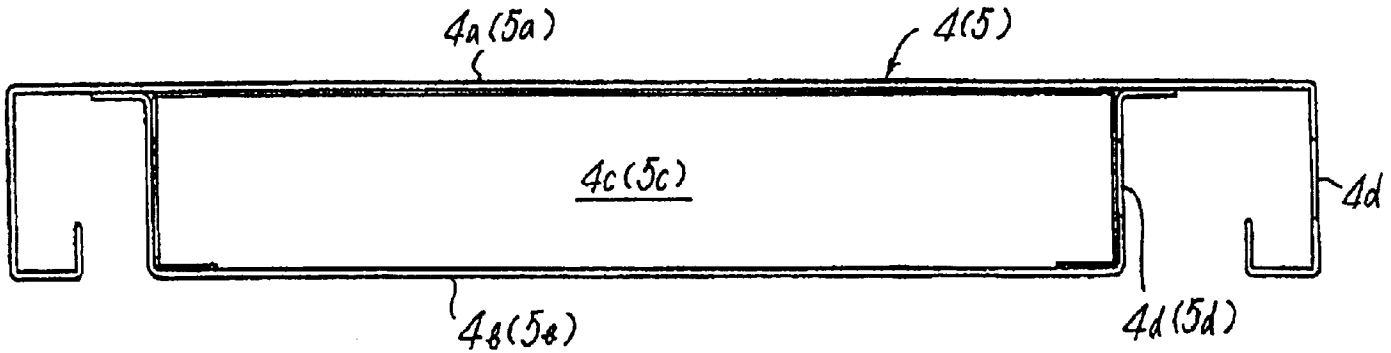
FIG. 6 is a perspective view illustrating a part of the storage with air purification function showing the third embodiment of the present invention.
Figure 6B:
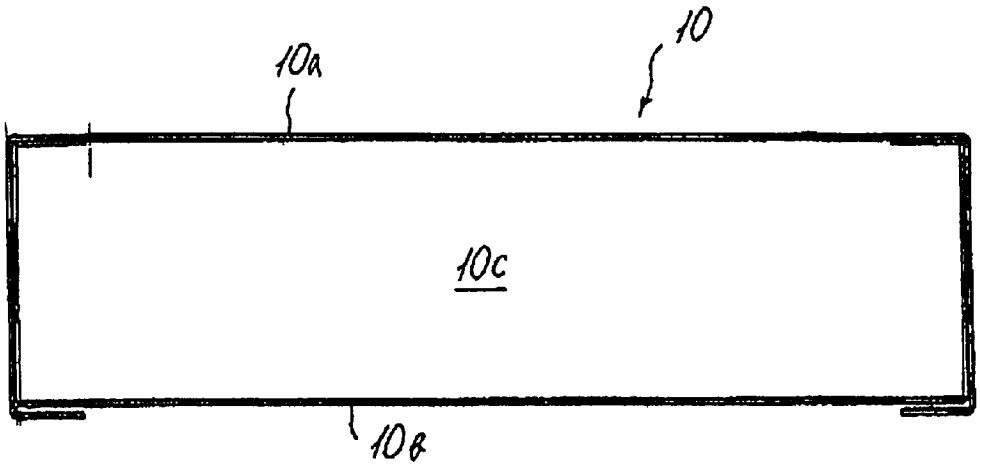

As shown in FIG. 6, the air duct 10 is connected at its lower end to the air purification unit 3 through an interconnecting port 10*d* and at its upper end to the shelf board combined outlet duct 5.

Further, in the area of the shelf board combined inlet duct 4 on which the air purification unit 3 is placed, as shown in FIG. 6, is formed an interconnecting port 4*e* for interconnecting the inlet path 4*c* of the shelf board combined inlet duct 4 to the interior space of a casing 3*a* of the air purification unit 3.

On the other hand, in the area of the lower end of the air duct 10 with which the casing 3*a* of the air purification unit 3 comes into contact, as shown in FIG. 6, is formed the interconnecting port 10*d* for interconnecting the ventilation path 10*c* of the air duct 10 to the interior space of the casing 3*a*.

Further, in the area of the upper end of the air duct 10 to which the shelf board combined outlet duct 5 is connected, as shown in FIG. 3, is formed an interconnecting port 10*e* for interconnecting the ventilation path 10*c* of the air duct 10 to the outlet path 5*c* of the shelf board combined outlet duct 5.

In the cabinet 1 in such a constitution, when the sirocco fan 31 of the air purification unit 3 is driven, as shown in FIG. 6, the air sucked into the inlet port 4*d* of the shelf board combined inlet duct 4 passes through the inlet path 4*c* and the interconnecting port 4*e* of the shelf board combined inlet duct 4 to be introduced into the casing 3*a* of the air purification unit 3.

The air thus introduced into the casing 3*a* of the air purification unit 3, first passes through the dust collection filter 32 and the odor eliminating means 33 provided inside of the casing 3*a*, so that the fine particles such as fungus spores, bacterium, pollen, dust and dead bodies of ticks in the air are collected with the dust collection filter 32, and the odor in the air is eliminated by the odor eliminating means 33.

The air purified by the air purification unit 3 then passes through the interconnecting port 10*d* and the ventilation path 10*c* of the air duct 10 to be sent into the outlet path 5*c* of the shelf board combined outlet duct 5 through the interconnecting port 10*e* of the air duct 10.

The clean air sent into the outlet path 5*c* of the shelf board combined outlet duct 5 is exhausted through the outlet port 5*d* of the shelf board combined outlet duct 5 and flows toward the inlet port 4*d* along the opening of the storage section 11 of the cabinet 1.

The air that flowed along the opening of the storage section 11 of the cabinet 1 is again sucked into the inlet port 4*d* of the shelf board combined inlet duct 4 and circulated through the inlet path 4*c*, the ventilation path 10*c*, and the outlet path 5*c*.

Thus, the clean air exhausted through the outlet port 5*d* of the shelf board combined outlet duct 5 forms an air curtain along the opening on the front side of the storage section 11 of the cabinet 1.

Further, the air in the storage section 11 of the cabinet 1 and the air around the cabinet 1 are circulated and purified while getting caught in a circulating airflow including the air curtain. The air curtain is formed such that its aerial layer wraps the shelf in, and the air inside of the shelf is to be purified by the circulation of the air. Also, the airflow produces a insect rejecting effect. The air curtain catches the air around the shelf as well, so that the air is also purified. Therefore, in the case of a self-standing shelf, the air between the shelves is also purified.

In such a manner as described, since the cabinet is arranged such that the air purification unit is installed on the shelf, and the air is purified in the shelf and within a limited area in the proximity thereof, it is unnecessary to purify the air in the entire room, so that energy can be saved, and the air can effectively be purified only in the necessary area.

The outlet port 5*d* of the shelf board combined outlet duct 5 may be arranged such that it is formed only in the reinforcing board 5*b* forming the outlet path 5*c* of the shelf board combined outlet duct 5. Thus, the air which is exhausted through the outlet port 5*d* of the shelf board combined outlet duct 5 is exhausted in the direction approximately along the opening on the front side of the storage section 11 of the cabinet 1, thereby causing the air curtain to be formed more reliably.

Further, the circulating speed of the air which is circulated by the air purification unit 3 is preferably set at 0.5 m/sec or lower. That is, generally, when the circulating speed of the air which is circulated by the air purification unit 3 is higher than 0.5 m/sec, some of the objects stored in the storage section of the storage can possibly be deteriorated by wind damage or weathered. Thus, the circulating speed of the air which is circulated by the air purification unit 3 is set at 0.5 m/sec or lower.

Figure 7:
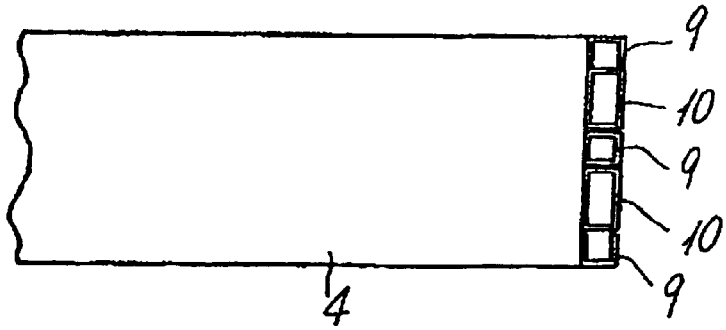
FIG. 7 is a schematic view illustrating the disposing position of the above air duct.

Further, in the cabinet 1 of the embodiment, as shown in FIG. 7, the air duct 10 is disposed between the plurality of support members 9 provided along one side of the cabinet 1. In the conventional cabinet, the space between the support members 9 is a dead space which can not receive any stored objects. In the embodiment, however, the dead space is effectively utilized for disposing the air duct 10 of the cabinet 1.

The airflow forming the air curtain may be reversed. That is, in the embodiment, the airflow caused by the sirocco fan 31 of the air purification unit 3 may be reversed so as to flow from the lower shelf toward the upper shelf of the cabinet 1.

Figure 8:
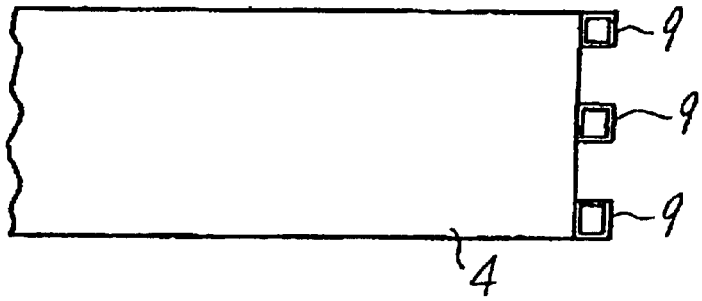
FIG. 8 is a schematic view of a constitution using the support as the above air duct.

Here, in place of the air duct 10, as shown in FIG. 8, the cabinet may be arranged such that the plurality of support members 9 provided along one side of the cabinet are formed in a hollow shape and serve as an air duct forming the ventilation path.

Thus, the ventilation path can be formed by utilizing the dead space in the cabinet 1, and by omitting the air duct 10, the constitution of the cabinet 1 is simplified, and cost reduction is effected.

Figure 9:
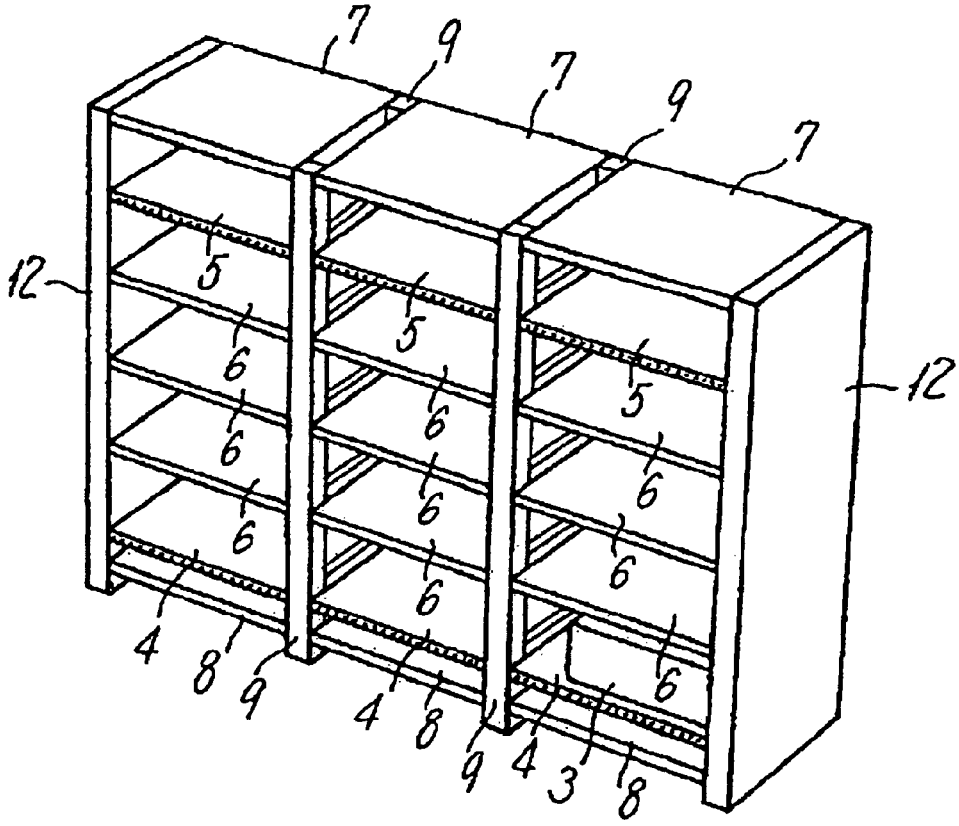
FIG. 9 is a schematic perspective view of the cabinet having a constitution using the sideboard as the above air duct.

Further, in place of the air duct 10 and the support members 9, as shown in FIG. 9, the cabinet may be arranged such that the shelf board combined inlet duct 4, the shelf board combined outlet duct 5, the shelf board 6, the top board 7, and the bottom board 8 are supported by a pair of right and left side boards 12 of a hollow shape, which serves as an inlet or outlet duct forming the ventilation path. The duct 4 may be arranged to be an outlet duct, and the duct 5 an inlet duct.

Thus, the ventilation path can be formed by utilizing the side boards 12 of the cabinet 1, and by omitting the air duct 10, the constitution of the cabinet 1 is simplified, and cost reduction is effected. Further, the appearance and strength of the sides of the cabinet 1 are improved.

Figure 10:
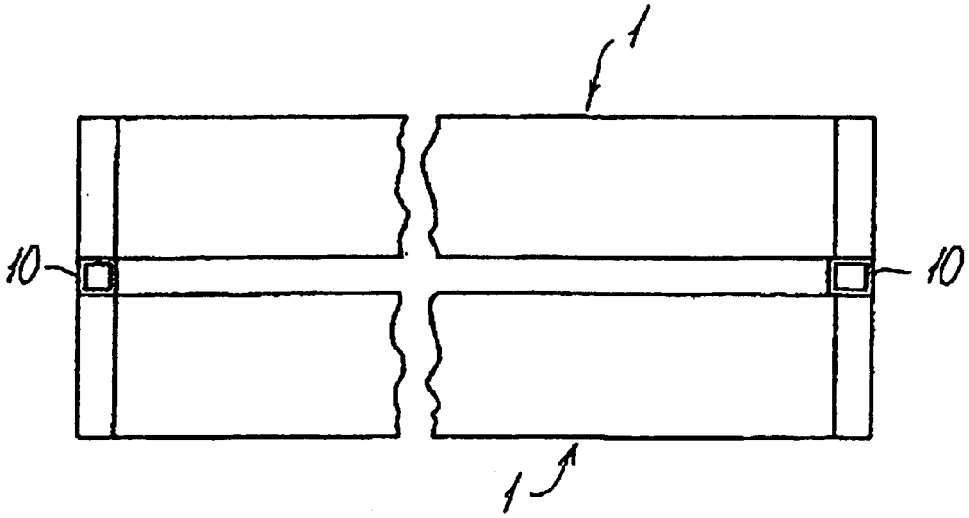
FIG. 10 is an illustration of the disposing position of the above air duct in case that plurality of cabinets is placed in back to back.

Furthermore, as shown in FIG. 10, in the cabinet arranged such that the plurality of cabinets 1 are placed back to back with the rear sides of the storage sections 11 apart from each other with a predetermined gap, the air duct 10 forming the ventilation path 10*c* may be disposed in the gap between the rear sides of the cabinets 1.

Thus, the air duct 10 can be disposed by utilizing the dead space between the cabinets 1, and in the case of the existing storage, the air duct 10 can be installed without disassembling or major alteration of the storage.

Figure 11:
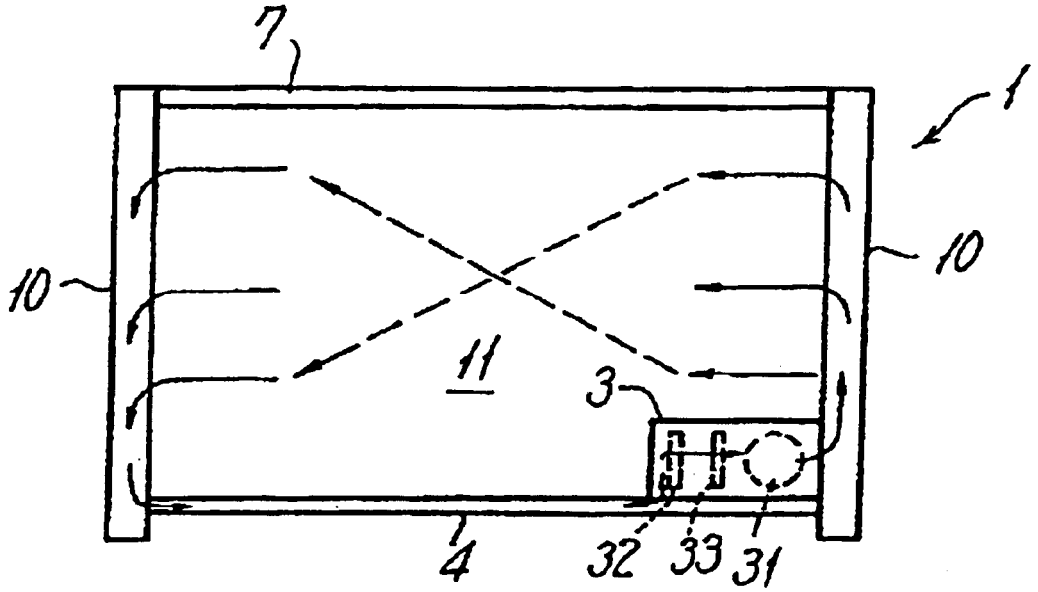
FIG. 11 is a schematic front view of the cabinet related to another embodiment of the present invention.

Here, the direction of the circulating airflow forming the air curtain may be arranged, instead of the vertical direction of the cabinet 1 as shown in FIG. 6, for example, as shown in FIG. 11, to be the direction of the circulating airflow moving from one side to the other side of the cabinet 1 (direction of the arrows shown in FIG. 11 by solid lines) or to be the direction obliquely along the opening of the storage section 11 (direction of the arrows shown in FIG. 11 by broken lines).

Figure 12:
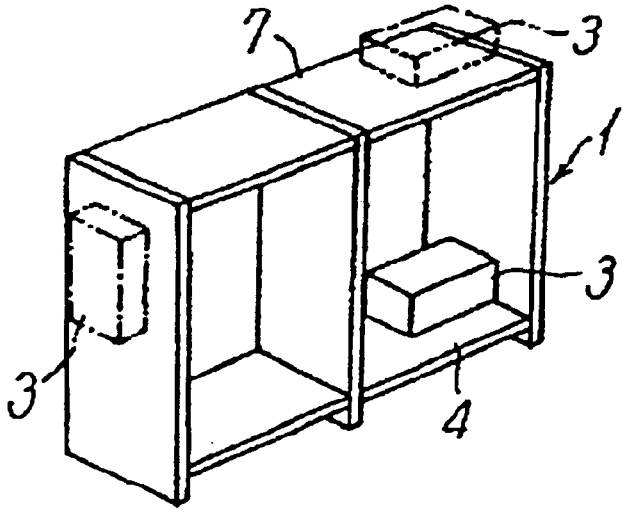
FIG. 12 is a schematic perspective view illustrating the disposing position of the air purification unit disposed in the above cabinet.

Further, while in the cabinet 1 of the embodiment, the air purification unit 3, as shown in FIG. 12 by solid lines, is disposed at the lower part of the cabinet 1, it may be arranged to be disposed on the side of the cabinet 1 as shown in the same by dot and dash lines or at the upper part of the cabinet 1 as shown in the same by double dot and dash lines.

The shape of the inlet and outlet ports may be circular, polygonal, or any other shape. That is, the inlet and outlet ports desirably have enough area to suck and exhaust necessary air volume.

The installing place of the duct is not particularly limited. It may be installed not only on the upper or lower shelf but also on the upper or lower side of any shelf board. Further, instead of the shelf board combined duct, a channel-like duct may be used and installed by utilizing the gap or the dead space in the cabinet. For example, it can be installed on the top board, underneath the ground board, or in the underframe of the cabinet. The duct may be a top board combined duct or a bottom board combined duct.

The air purification unit may be arranged at any position, for example, on or underneath any shelf board.

Next will be described the result of the analysis by simulating of the aspects of the air curtain and the circulating airflow formed in the front (along the opening) of the storage section 11 of the cabinet 1 relating to the embodiment.

EXAMPLE 1

Type of Cabinet; Open Type (Self-Standing Shelf)

Blowoff direction of circulating airflow; Two ways (downward) along the openings in the front and back of the cabinet Average blowoff wind velocity; 0.24 (m/sec)

Book loading ratio in the receiving section of the cabinet; 0%

Figure 13:
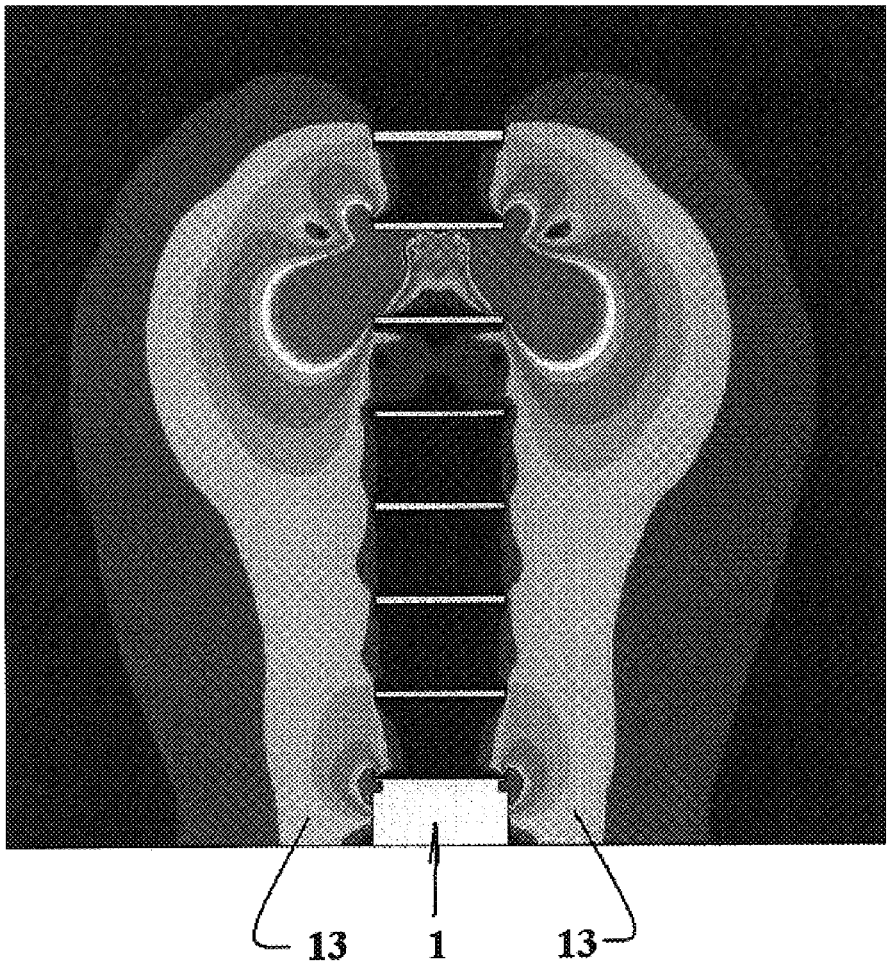
FIG. 13 is a sectional view showing the air curtain formed in the cabinet opening of the first embodiment of the present invention.

Under the above conditions, the air curtain 13 of about 600 mm in thickness (on one side) as shown in FIG. 13 was formed along the openings in the front and back of the cabinet 1.

EXAMPLE 2

Type of Cabinet; Open Type (Self-Standing Shelf)

Blowoff direction of circulating airflow; Two ways (horizontal) along the openings in the front and back of the cabinet Average blowoff wind velocity; 0.24 (m/sec)

Book loading ratio in the receiving section of the cabinet; 0%

Figure 14:
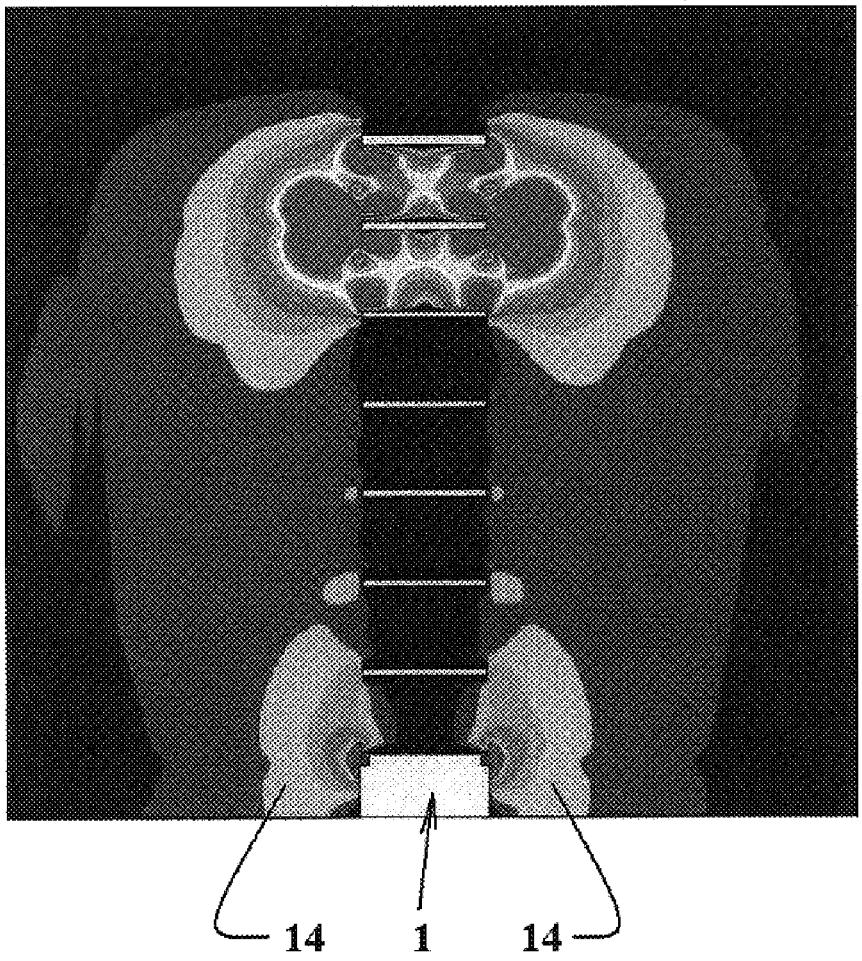
FIG. 14 is a sectional view showing the air curtain formed in the cabinet opening of the second embodiment of the present invention.

Under the above conditions, the air curtain 14 of about 600 mm in thickness (on one side) as shown in FIG. 14 was formed along the openings in the front and back of the cabinet 1.

EXAMPLE 3

Type of Cabinet; Open Type (Self-Standing Shelf)

Blowoff direction of circulating airflow; Two ways (downward) along the openings in the front and back of the cabinet Average blowoff wind velocity; 0.24 (m/sec)

Book loading ratio in the receiving section of the cabinet; 100%

Figure 15:
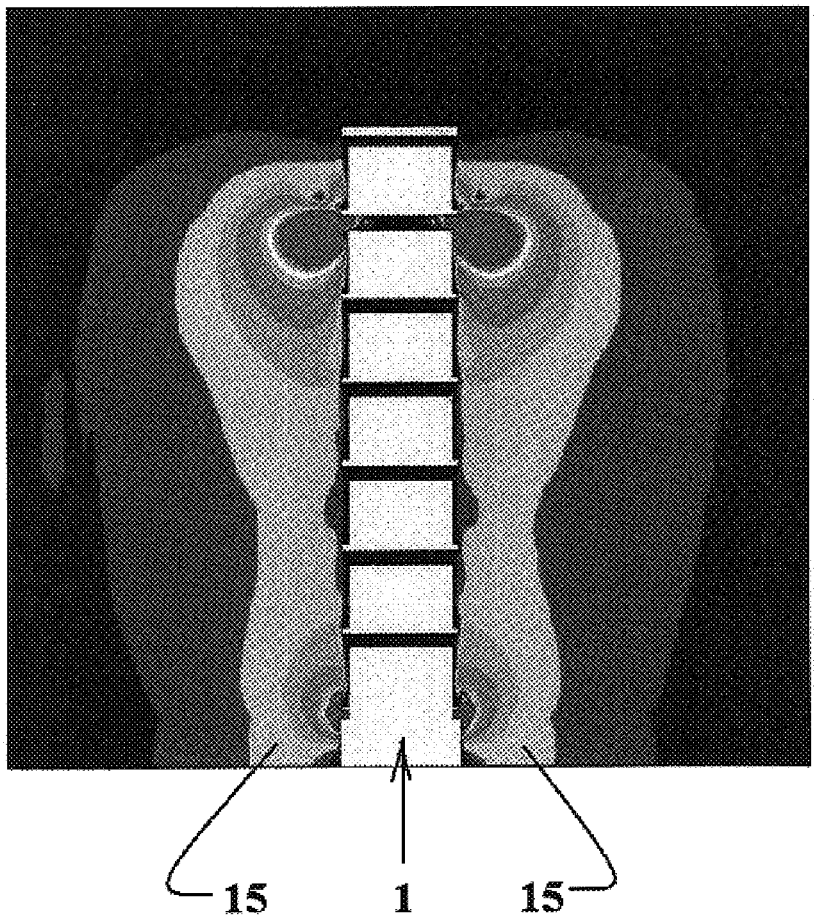
FIG. 15 is a sectional view showing the air curtain formed in the cabinet opening of the third embodiment of the present invention.

Under the above conditions, the air curtain 15 of about 600 mm in thickness (on one side) as shown in FIG. 15 was formed along the openings in the front and back of the cabinet 1.

EXAMPLE 4

Type of Cabinet; Open Type (Self-Standing Shelf)

Blowoff direction of circulating airflow; Two ways (horizontal) along the openings in the front and back of the cabinet Average blowoff wind velocity; 0.24 (m/sec)

Book loading ratio in the receiving section of the cabinet; 100%

Figure 16:
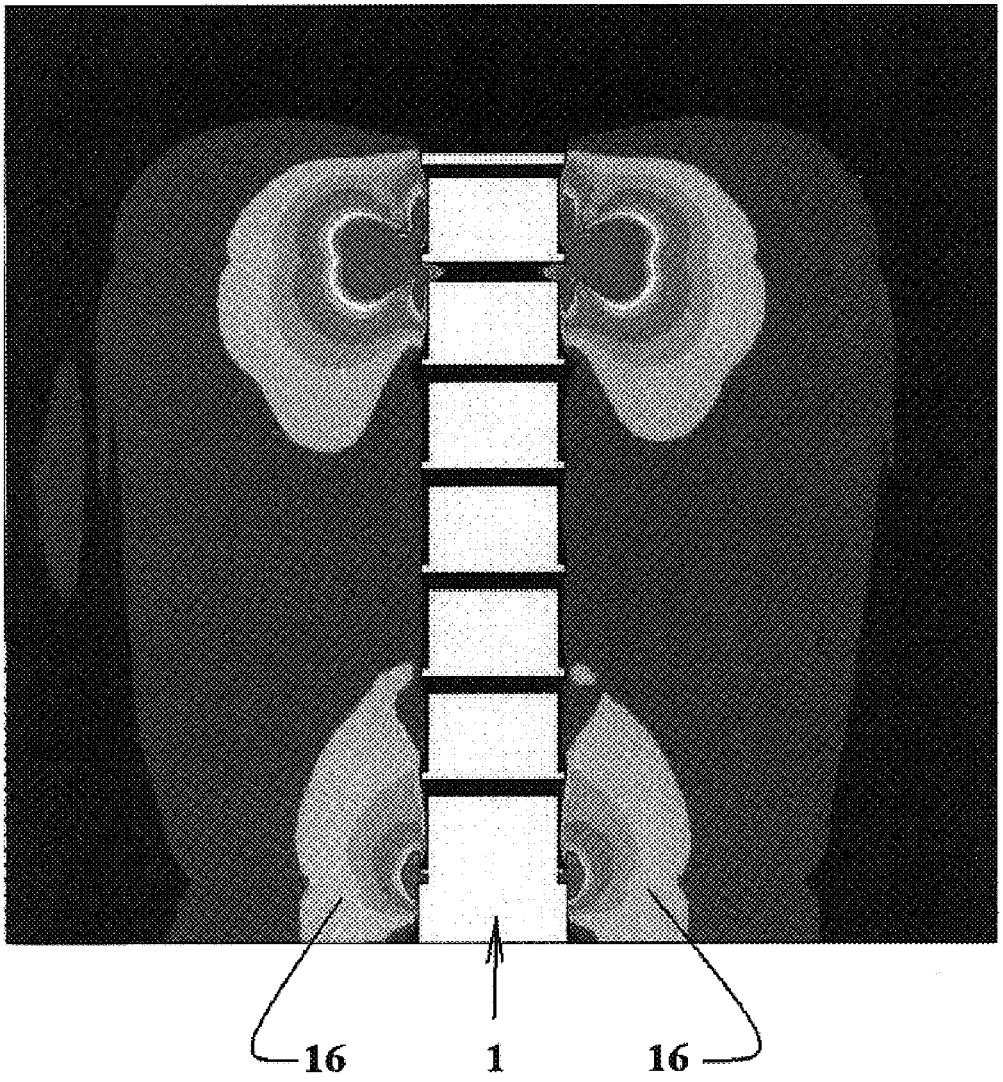
FIG. 16 is a sectional view showing the air curtain formed in the cabinet opening of the fourth embodiment of the present invention.

Under the above conditions, the air curtain 16 of about 600 mm in thickness (on one side) as shown in FIG. 16 was formed along the openings in the front and back of the cabinet 1.

EXAMPLE 5

Type of Cabinet; Closed Type (Movable Shelf)

Blowoff direction of circulating airflow; One way (downward) along the opening of the cabinet Average blowoff wind velocity; 0.24 (m/sec)

Book loading ratio in the receiving section of the cabinet; 0%

Air purification unit; Six movable shelves were placed adjacent to each other with the air purification unit installed only on the shelf at the right end of FIG. 17

Figure 17:
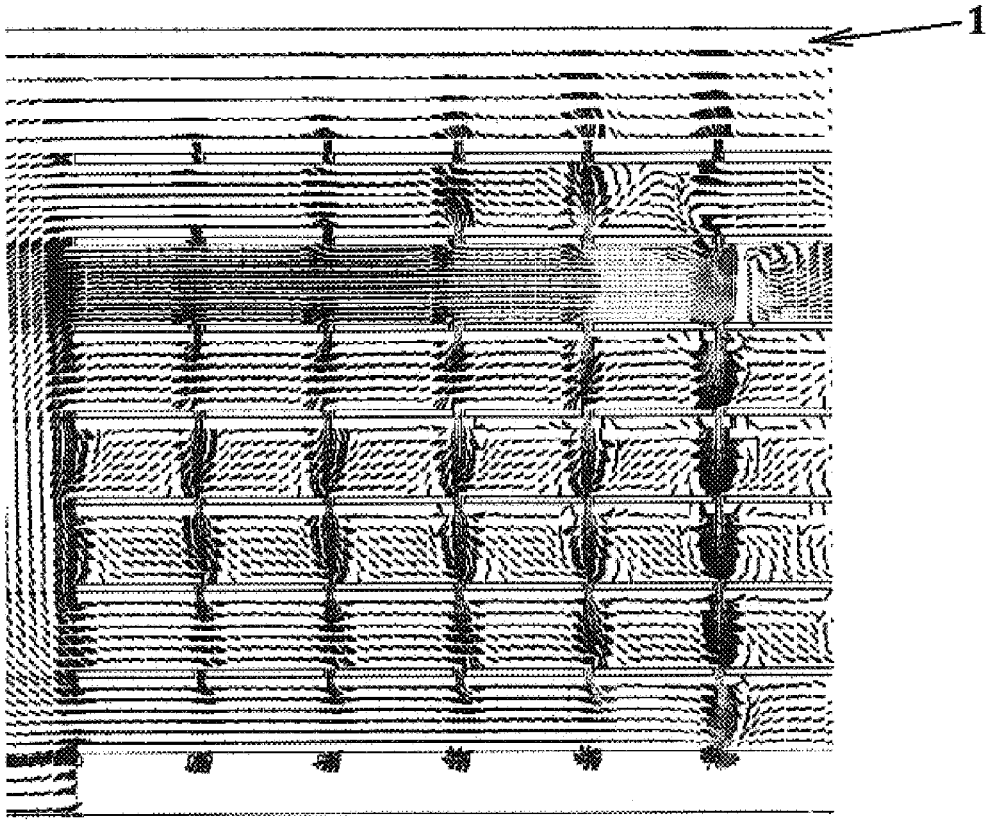
FIG. 17 is a sectional view showing the air curtain formed in the cabinet opening of the fifth embodiment of the present invention.

Under the above conditions, a circulating flow path as shown in FIG. 17 was formed along the opening of the cabinet 1 provided with the air purification unit and the openings of the cabinets adjacent thereto. This simulation showed that a single air purification unit allowed the effective purification of the air in the four movable shelves.

EXAMPLE 6

Type of Cabinet; Closed Type (Movable Shelf)

Blowoff direction of circulating airflow; One way (downward) along the opening of the cabinet Average blowoff wind velocity; 0.24 (m/sec)

Book loading ratio in the receiving section of the cabinet; 100%

Air purification unit; Six movable shelves were placed adjacent to each other with the air purification unit installed only on the shelf at the right end of FIG. 18

Figure 18:
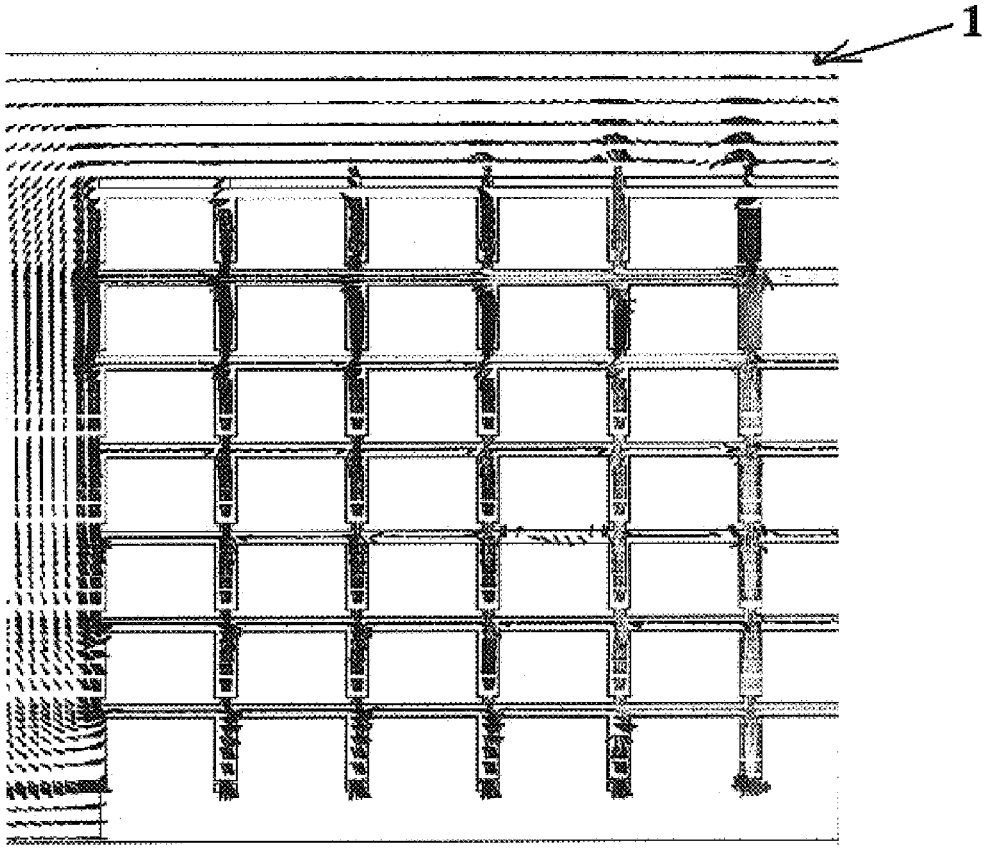
FIG. 18 is a sectional view showing the air curtain formed in the cabinet opening of the sixth embodiment of the present invention.

Under the above conditions, a circulating flow path as shown in FIG. 18 was formed along the opening of the cabinet 1 and the openings of the cabinets adjacent thereto. This simulation showed that a single air purification unit allowed the effective purification of the air in the four movable shelves.

EXAMPLE 7

Type of Cabinet; Closed Type (Movable Shelf)

Blowoff direction of circulating airflow; One way (downward) along the opening of the cabinet Average blowoff wind velocity; 0.48 (m/sec)

Book loading ratio in the receiving section of the cabinet; 100%

Figure 19:
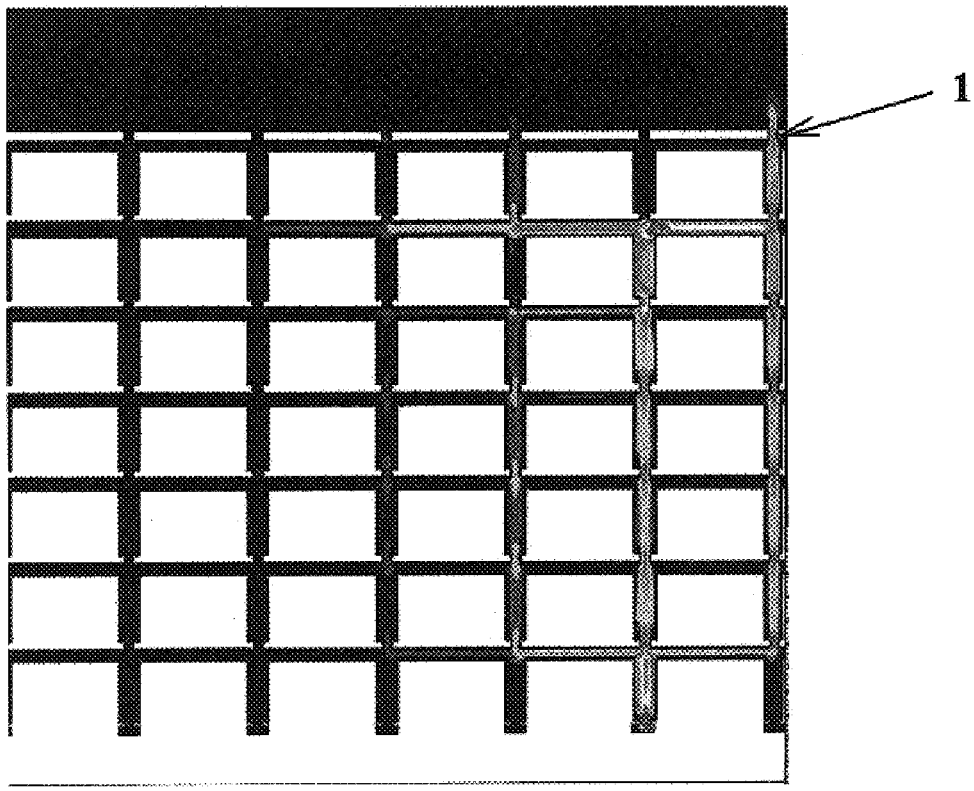
FIG. 19 is a sectional view showing the air curtain formed in the cabinet opening of the seventh embodiment of the present invention.

Air purification unit;

Six movable shelves were placed adjacent to each other with the air purification unit installed only on the shelf at the right end of FIG. 19

Under the above conditions, a circulating flow path as shown in FIG. 19 was formed along the opening of the cabinet 1 and the openings of the cabinets adjacent thereto. This simulation showed that a single air purification unit allowed the effective purification of the air in the four movable shelves.

Next, dust collection performance of the cabinet 1 of the embodiment will be described below.

The dust collection performance of the cabinet 1 was evaluated by conducting a decrement test of dust concentration in the atmospheric air surrounding the cabinet 1. The dust collection filter 32 of the air purification unit 3 used for the test was one formed a filter (JIS colorimetric method 90%) with a pre-filter in one body.

Figures 20A, 20B:
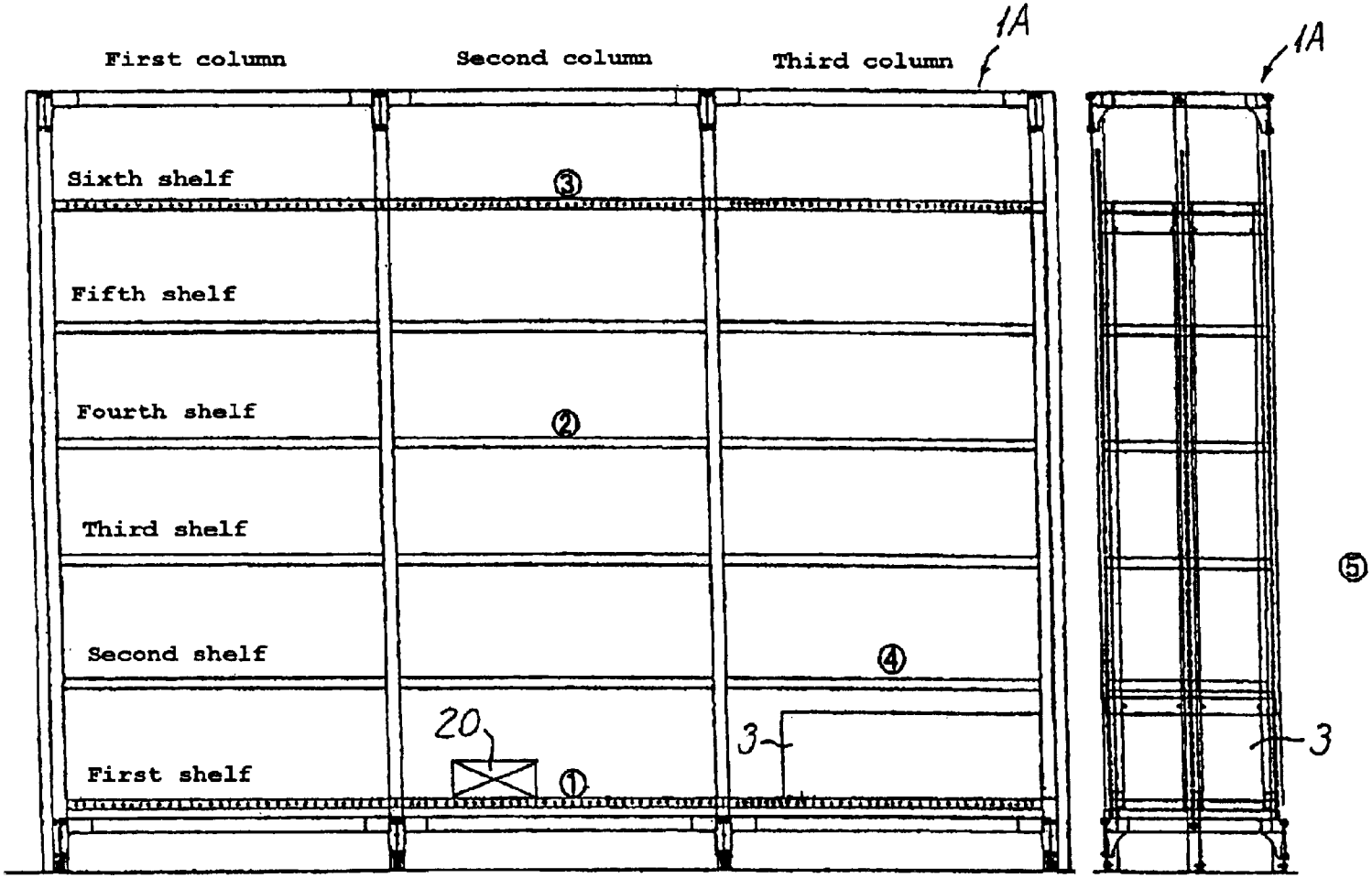
FIGS. 20(*a*) and 20(*b*) are a front view and a side view of a tested shelf used in a decrement test of dust concentration of atmospheric air around the above cabinet.

Procedures for the decrement test are as follows:

(1) A tested shelf 1A as shown in FIG. 20 of the same constitution as that of the cabinet 1 was set up in a testing room with walls of stainless steel plates (floor area of about 4000 mm×4000 mm and ceiling height of about 3000 mm). Here, using stainless steel as a wall material in the testing room can reduce the effect of decrement of dust concentration caused by the dust adhering to the wall surfaces.

(2) Incense was burned in the sealed testing room, and then the air in the testing room was well stirred with a fan.

(3) The dust concentration in the testing room was measured with a digital dust meter (hereinafter called "dust meter"), and the fan was turned off when the dust concentration reached 0.3 (mg/m3), and then the air purification unit 3 of the cabinet 1 was operated.

(4) Along with the operation of the air purification unit 3, the measurement of the dust concentration was started with the dust meter, and the result of which was successively recorded with a plotter placed outside of the testing room.

(5) Procedures (2) through (4) above were repeated by varying the number of paths of the air ducts of the cabinet 1 (1 for the one-way blowoff and 2 for the two-way blowoff) and the installing locations of the dust meter.

(6) For comparison, the dust concentration in the testing room was measured with the dust meter in item (3) in case that the air purification unit 3 was not operated and the dust concentration was naturally decreased.

The dust meter 20 was installed on the first shelf board in the second column of the tested shelf 1A as shown in FIG. 20 (position shown in FIG. 20(*a*) by numeral 1 with a circle) to conduct the decrement test as specified in procedures (2) through (6) above. As a result, a graph shown in FIG. 21, illustrating the relation between the dust concentration (mg/m3) and time (min), was obtained.

TEST EXAMPLE 1

Figure 21:
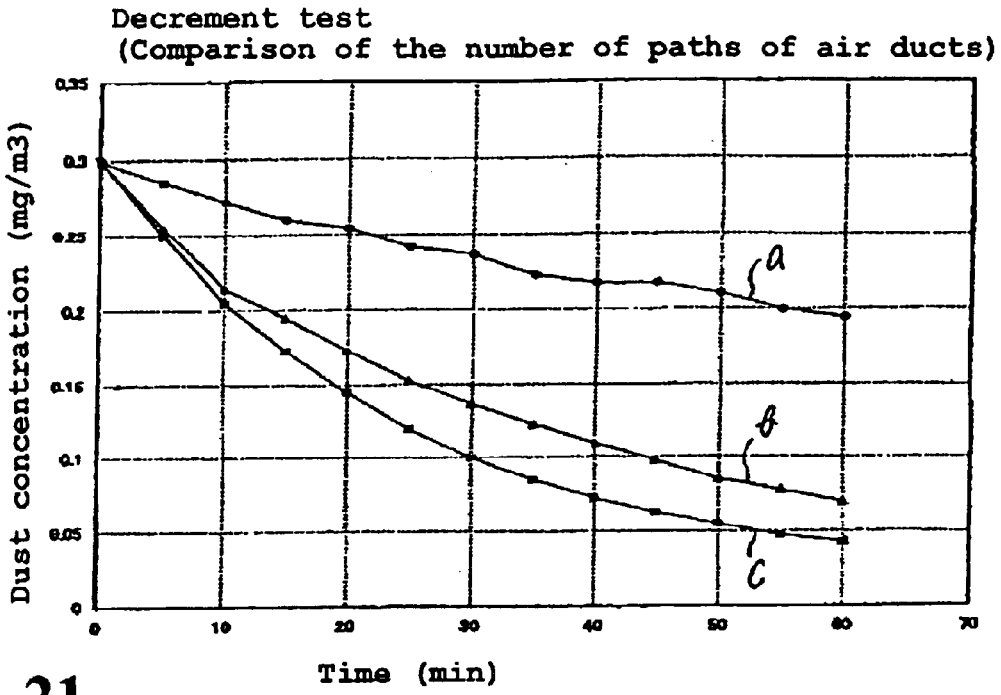
FIG. 21 is a graph illustrating the relation between dust concentration (mg/m3) showing the result of the decrement test and time (min).

In FIG. 21, polygonal line (a) plotted with black dots " " shows the result of the test in case that the dust concentration in the testing room was naturally decreased. This polygonal line a shows that, in the case of the natural decrement, the air flowing out through small gaps in the testing room causes the dust concentration to be decreased as the time elapses. That is, in this case, the dust concentration was decreased from 0.3 (mg/m$^3$) at the start of the measurement to 0.195 (mg/m$^3$) after 60 (min).

TEST EXAMPLE 2

In FIG. 21, polygonal line (b) plotted with black triangles "▲" shows the result of the test in case that the dust concentration in the testing room was decreased by operating the air purification unit 3.

This decrement test was conducted under the following conditions: book loading ratio; 100%, the number of paths of the air ducts; 1, and blowoff direction of the circulating airflow; downward.

In this case, the polygonal line (b) shows that the dust concentration is greatly decreased from 0.3 (mg/m$^3$) at the start of the measurement to 0.07 (mg/m$^3$) after 60 (min).

TEST EXAMPLE 3

In FIG. 21, polygonal line (c) plotted with black squares "■" shows the result of the test that the dust concentration in the testing room was decreased by operating the air purification unit 3.

This decrement test was conducted under the following conditions: book loading ratio; 100%, the number of paths of the air ducts; 2, and blowoff direction of the circulating airflow; downward.

In this case, the polygonal line (c) shows that the dust concentration is greatly decreased from 0.3 (mg/m$^3$) at the start of the measurement to 0.043 (mg/m$^3$) after 60 (min).

As is apparent from the results of the foregoing (Test example 2) and (Test example 3), it was verified that, in the cabinet 1 of the foregoing constitution, the dust collection performance became higher as the number of paths of the air ducts became larger.

Also, it was verified that the dust collection performance was higher in both (Test example 2) and (Test example 3) than in the (Test example 1), in which the dust concentration was naturally decreased.

Next, the dust meter 20 was installed on the tested shelf 1A as shown in FIG. 20 at the positions shown by numerals 1, 2, 3, 4, and 5 with circles to conduct the decrement test as specified in procedures (2) through (6) above. As a result, a graph shown in FIG. 22, illustrating the relation between the dust concentration (mg/m$^3$) and the time (min), was obtained.

This decrement test was conducted under the following conditions: book loading ratio; 100%, the number of paths of the air ducts; 2, and blowoff direction of the circulating airflow; downward.

Figure 22:
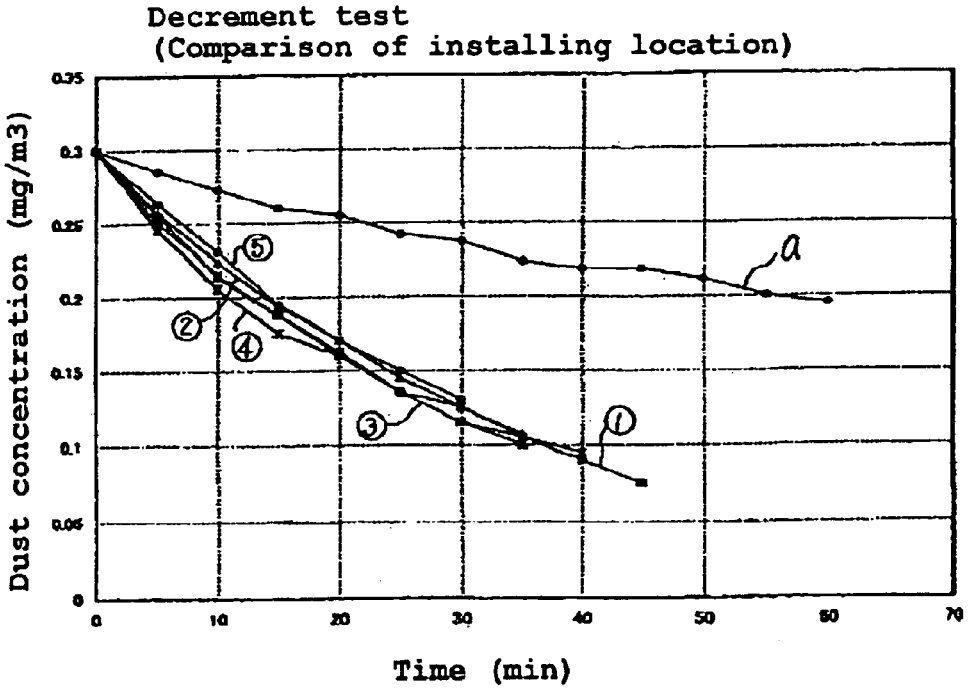
FIG. 22 is a graph illustrating the relation between dust concentration (mg/m3) showing the other result of the decrement test and time (min).

In FIG. 22, polygonal line (a) shows the result of the test that the dust concentration in the testing room was naturally decreased.

Also, in FIG. 22, the respective polygonal lines shown by numerals 1, 2, 3, 4, and 5 with circles show the results of the tests corresponding to the respective installing positions of the dust meter 20, shown in FIG. 20.

As illustrated in a graph of FIG. 22, if the installing locations of the dust meter 20 changed, the dust concentration in the storage section of the tested shelf 1A was decreased at generally the same decrement rate, and it was verified that generally a uniform dust collection effect was obtained over roughly the entire region in the storage section.

Further, as shown in FIG. 22 by polygonal line 5, it turned out that the dust collection effect was obtained even outside of the tested shelf 1A in the proximity thereof. The reason is that the air curtain catches the air around the tested shelf 1A as well, which is to be purified by the air purification unit 3.

Next, odor eliminating performance of the air purification unit 3 will be described below.

Octyl alcohol (2-ethylhexyl alcohol) was used as an odor analyte for verifying odor intensity.

Since there are a lot of unknown about odor components of the octyl alcohol, first, an odor intensity confirmation test was conducted by the total of six panelists (including one female) before an odor eliminating test for evaluating the odor eliminating performance was conducted.

Procedure for the odor intensity confirmation test were that: 0.7 g of octyl alcohol was intermittently heated to evaporate in a SUS container of a volume of 1 $m^3$, and then a sensory evaluation was made after a specific period of time (The theoretical peak value of the analyte concentration reaches about 120 ppm).

Further, the test was conducted with nine samples prepared as an odor analyte. Incidentally, the odor concentration reached its peak value in the fifth odor analyte, so only the first through fifth odor analytes were used for test data.

Then, the foregoing six panelists made the sensory evaluation of which level the odor intensity for the respective odor analytes of No. 1–5 fell under in "Table of six levels of odor intensity" shown in Table 1. The result of this sensory evaluation is shown in Table 2.

TABLE 1

Table of six levels of odor intensity

| Odor intensity | Description |
|---|---|
| 0 | No odor |
| 1 | Odor that can barely be detected |
| 2 | Weak odor that can be recognized |
| 3 | Odor that can easily be recognized |
| 4 | Strong odor |
| 5 | Intense odor |

TABLE 2

Sensory evaluation

| Odor analyte | Odor intensity (Number of panelists) | | | | | | Analyte concentration |
|---|---|---|---|---|---|---|---|
| No. | 0 | 1 | 2 | 3 | 4 | 5 | [ppm] |
| 1 | 6 | | | | | | 1.3 |
| 2 | 4 | 1 | 1 | | | | 3.3 |
| 3 | | 1 | 3 | 2 | | | 49.0 |
| 4 | | | 2 | 2 | 2 | | 77.0 |
| 5 | | | 1 | 1 | 1 | 3 | 110.8 |

Based on the sensory evaluation by the panelists shown in the Table 2, the respective odor analyte concentration (gas concentration) and their average odor intensity are shown in Table 3.

TABLE 3

| Gas concentration [ppm] | Odor intensity [–] |
|---|---|
| 1.3 | 0 |
| 3.3 | 0.5 |
| 49 | 2.2 |
| 77.1 | 3 |
| 110.8 | 4 |

Figure 23:
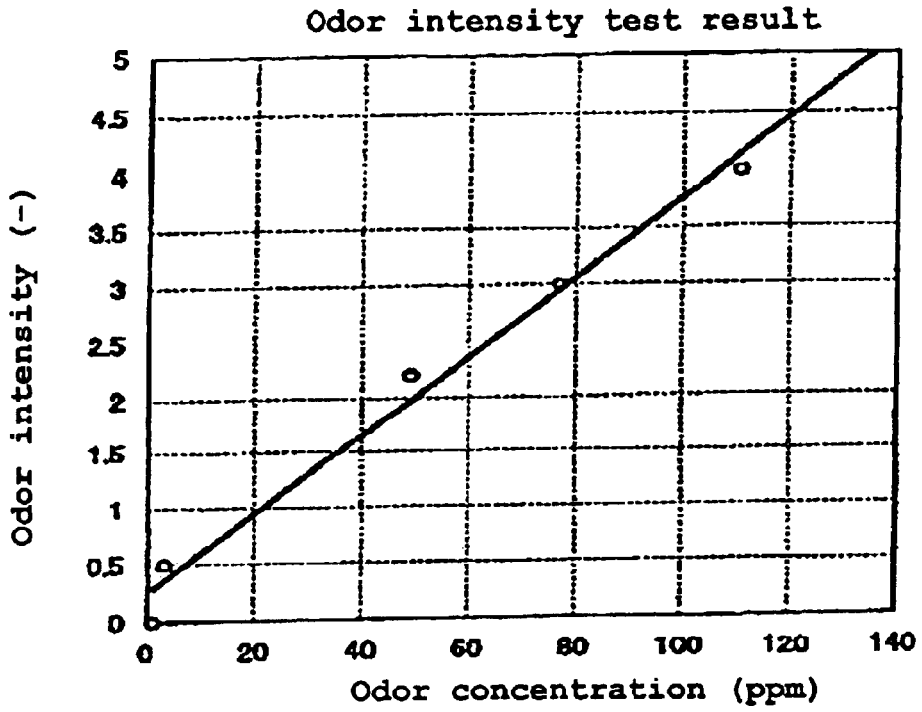
FIG. 23 is a graph illustrating the relation between odor intensity (6 degrees) and odor concentration (ppm) of octyl alcohol of resulted odor intensity confirmation test.

FIG. 23 is a graph, illustrating the result of the odor intensity verification test shown in the Table 3, that is, the relation between the odor intensity (6 levels) and the odor concentration (ppm) of the octyl alcohol.

This graph shows that the odor components of the octyl alcohol have level 1 of the odor intensity (odor that can barely be detected) at the odor concentration of around 22 ppm. As compared to the major bad odor components such as ammonia, the odor concentration of the octyl alcohol is very high.

Next, in view of the result of the foregoing odor intensity verification test, the odor eliminating test was conducted with the octyl alcohol (2-ethylhexyl alcohol) as a test odor.

Procedure for the odor eliminating test was that: 0.3 g (about 60 ppm) of octyl alcohol was heated to evaporate in the SUS container of a volume of 1 $m^3$, and then, after it became stable, the air purification unit 3 was operated to conduct the decrement test of the residual concentration of the octyl alcohol.

An odor eliminating means 33 of the air purification unit 3 used for the test had a photocatalyst (titanium oxide catalyst) and a special INV lamp provided side by side.

As a result of conducting this decrement test three times in the same manner, it became clear that the residual concentration of the octyl alcohol, as shown in Table 4, was decreased as the time elapsed.

TABLE 4

| Time (min) | First time | Second time | Third time |
|---|---|---|---|
| 0 | 60.00 | 60.00 | 60.00 |
| 5 | 12.13 | 6.32 | 7.06 |
| 10 | 7.32 | 5.76 | 5.37 |
| 15 | 5.06 | 5.47 | 4.79 |
| 20 | 3.22 | 5.36 | 5.19 |
| 25 | 3.01 | | 4.23 |

Figure 24:
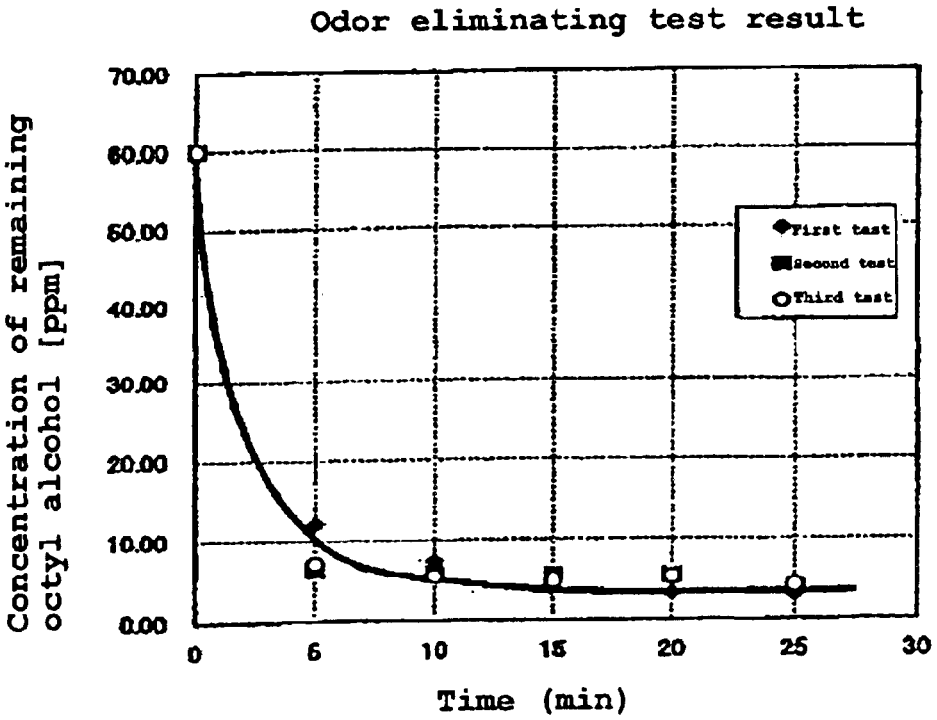
FIG. 24 is a graph illustrating the relation between residual concentration (ppm) of octyl alcohol of resulted deodorizing test and time (min).

Based on the Table 4, a graph as shown in FIG. 24, illustrating the result of the odor eliminating test, that is, the relation between the residual concentration (ppm) of the octyl and the time (min) was obtained.

As a result, it became clear that the air purification unit 3 rapidly decreased the residual concentration of the octyl alcohol from about 60 ppm at the start of the test to about 5 ppm (around one twelfth of the initial concentration) after 15 minutes.

The results of the foregoing three tests also made it clear that the residual concentration of the octyl alcohol was decreased without large dispersion.

The results of the odor eliminating test shows that, referring to the odor intensity shown in FIG. 23, the intensity was decreased from about 2.5 at the start of the test to 1 (22 ppm) or less after 5 minutes, and to 0.5 (8 ppm) or less after 15 minutes.

As a result, it became clear that a sufficient odor eliminating effect was obtained with the air purification unit 3.

Further, since the octyl alcohol is one of the odor components of molds, it is determined that the air purification unit 3 is quite effective in the musty odor.

Figures 25A, 25B:
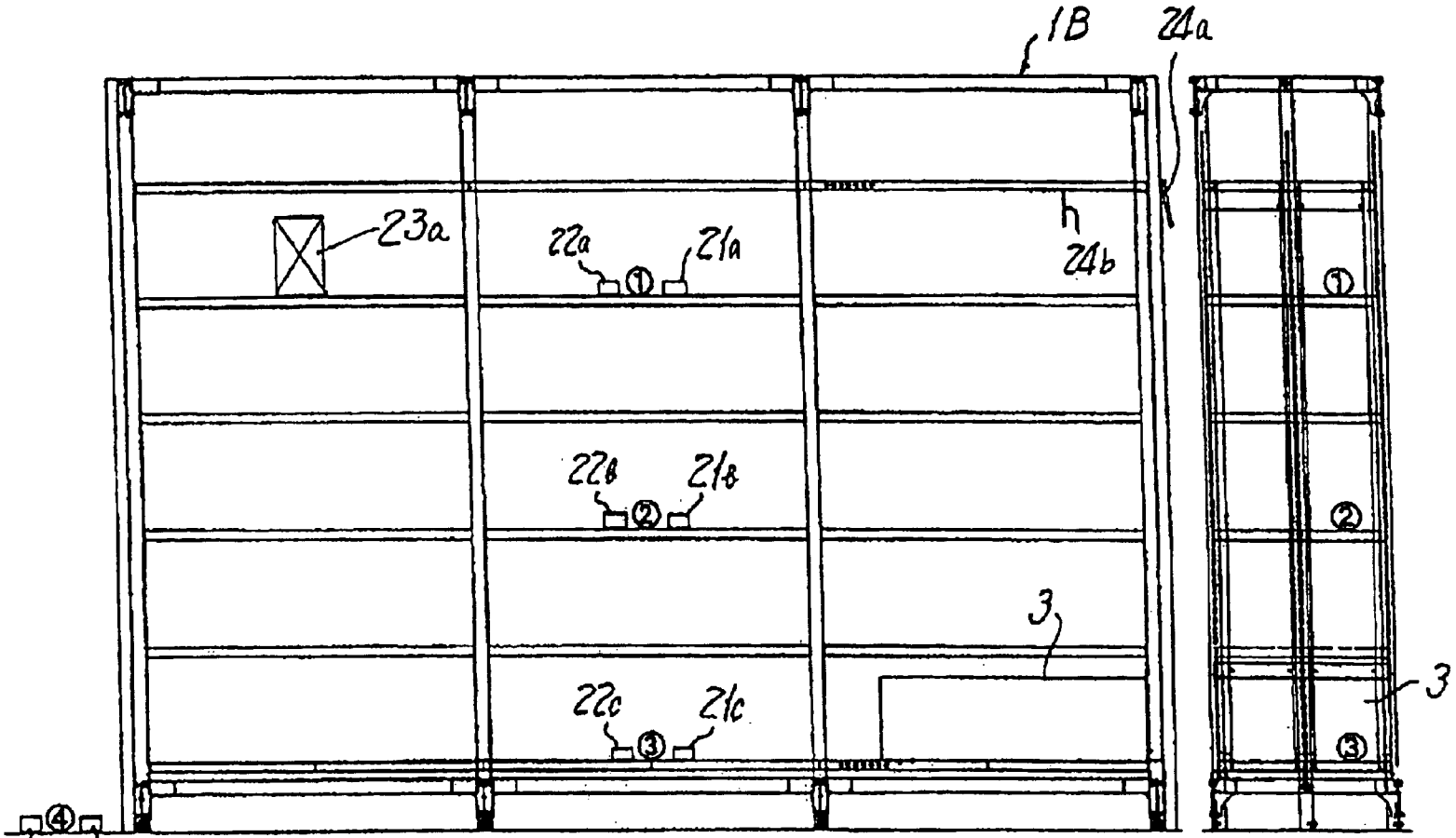
FIGS. 25(*a*) and 25(*b*) are a front view and a side view of the other tested shelf used in a test for evaluating the purification performance of a self-standing cabinet and the performance of the above air curtain.

Next will be described the result of the measurement of temperature and humidity, the number of settling microbes, the dust concentration, and environmental monitoring in the storage section by using a self-standing tested shelf 1B as shown in FIG. 25.

Thermohygrometers 21*a*, 21*b*, 21*c*, and 21*d* and petri dishes for settling microbes 22*a*, 22*b*, 22*c*, 22*d* were placed on the tested shelf 1B at the positions shown by numerals 1, 2, 3, and 4 with circles, respectively, to measure the temperature and humidity and the number of settling microbes inside and outside of the storage section of the tested shelf 1B.

Further, an air checker 23*a* as a dust concentration measuring apparatus was placed in the storage section of the tested shelf 1B to measure the dust concentration inside and outside of the storage section of the tested shelf 1B.

Furthermore, environmental monitors 24*a* and 24*b* were placed on the outer side and in the storage section of the tested shelf 1B, respectively, to measure environmental cleanliness inside and outside of the storage section of the tested shelf 1B.

Figure 26:
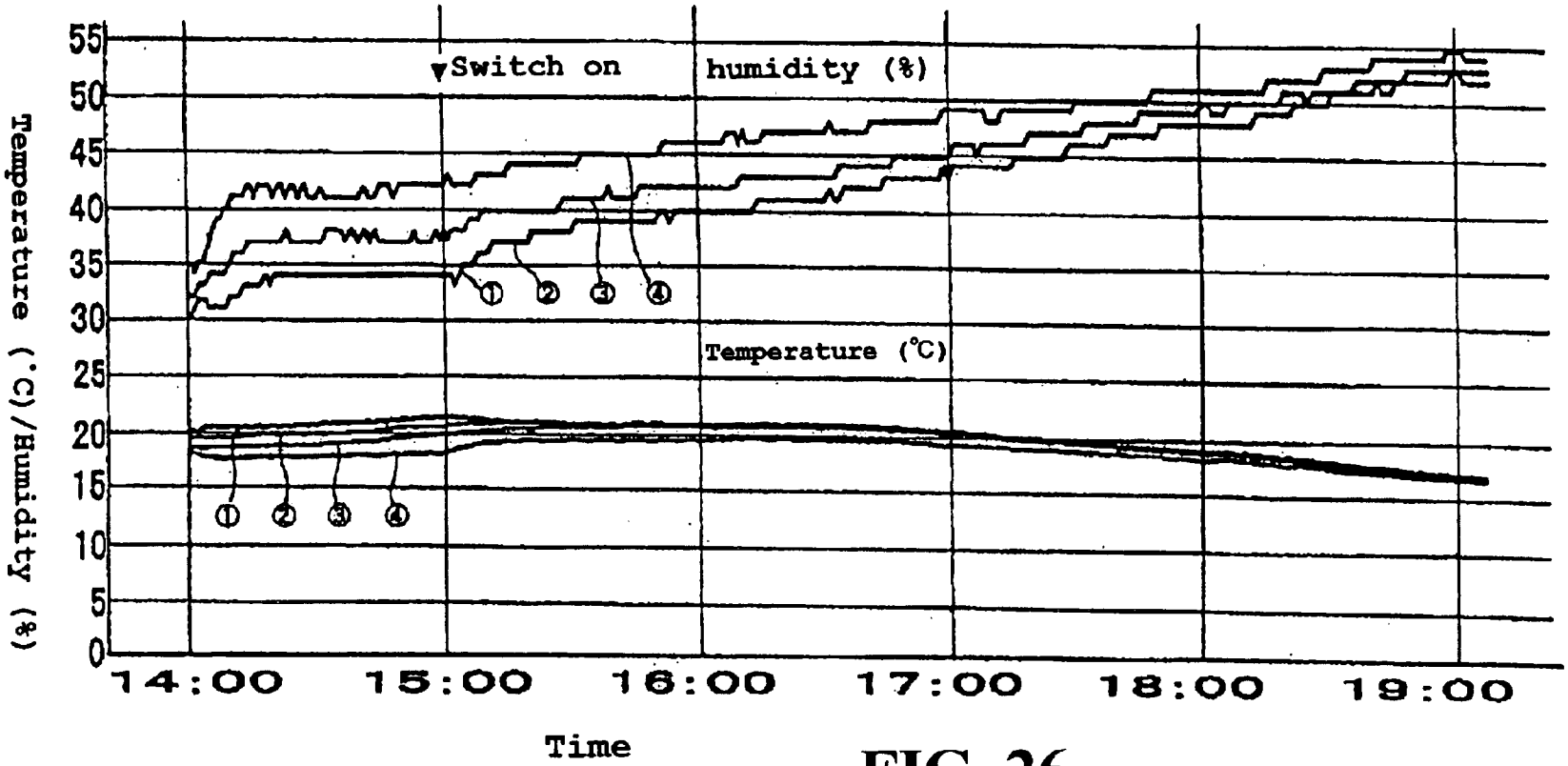
FIG. 26 is a graph showing a result of temperature and humidity measurement in the above self-standing test shelf.

FIG. 26 is a graph, illustrating the result of the measurement of the temperature and humidity inside and outside of the storage section of the tested shelf 1B with the thermohygrometers 21*a*, 21*b*, 21*c*, and 21*d*.

This graph indicates that the inside of the storage section of the tested shelf 1B before the air purification unit 3 is operated is in the environment of at its lower shelf (numeral 3 with a circle) low temperature and high humidity, at its upper shelf (numeral 1 with a circle) high temperature and low humidity, and at its middle shelf (numeral 2 with a circle) middle temperature and humidity.

Here, comparison of the environment in the upper and lower shelves indicates that the greatest temperature difference and the average temperature difference are 1.9 (° C.) and 1.7 (° C.), respectively, and the greatest relative humidity difference and the average relative humidity difference are 6 (%) and 4 (%), respectively, before the air purification unit 3 is operated.

Meanwhile, comparison of the environment in the upper and lower shelves after the air purification unit 3 is operated (switched on) indicates that the average temperature difference is converged at 0.3 (° C.) and the average relative humidity difference 1 (%), and that the temperature and humidity environment inside of the storage section is improved to be roughly averaged.

Further, comparison of the temperature and humidity environment inside of the storage section (numerals 1–3 with circles) and outside of the storage section (numeral 4 with a circle) of the tested shelf 1B, as shown in FIG. 26, indicates that the operation of the air purification unit 3 causes the temperature and humidity environment inside of the storage section to shift to be converged while being influenced by the temperature and humidity environment outside of the storage section. This indicates that an airflow (convection) occurs in the storage section of the tested shelf 1B, which means that the storing environment of objects is maintained at constant temperature and humidity.

Figure 27:
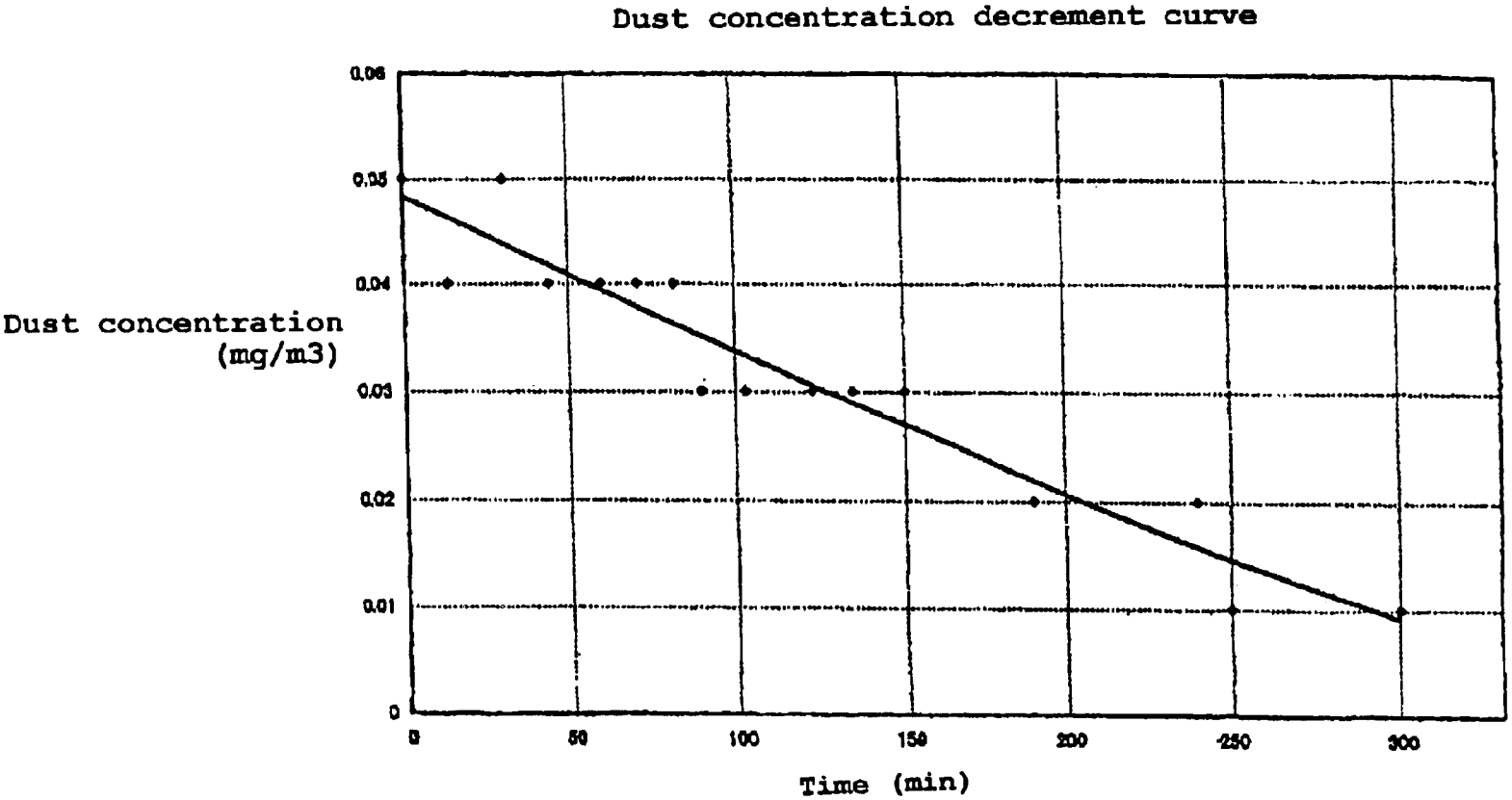
FIG. 27 is a graph showing a result of dust concentration measurement in the above self-standing test shelf.

FIG. 27 is a dust concentration decrement curve, illustrating with a graph the relation between the dust concentration (mg/m$^3$) measured with the air checker and the operating time (min) of the air purification unit.

As is clear from this graph, after the air purification unit 3 is operated, the dust concentration is decreased as the time elapses, the air in the storage section is purified, so that it turns out that the air purification has an effect on the low dust concentration under the general environmental condition.

Table 5 shows the result of the measurement of the operating time (min) of the air purification unit 3 and the number of the settling microbes including mold and bacterium collected in the petri dishs for settling microbes, 22*a*, 22*b*, 22*c*, and 22*d*. A culture medium is of potato dextrose agar.

TABLE 5

Settling microbe test

| position | Measuring | | | | | |
|---|---|---|---|---|---|---|
| Operating time (min) | 22a | 22b | 22c | 22d | Total | Average |
| 0 | 8 | 9 | 17 | 20 | 54 | 13.5 |
| 5 | 4 | 4 | 0 | 5 | 13 | 3.2 |
| 30 | 0 | 2 | 5 | 3 | 10 | 2.5 |
| 180 | 1 | 2 | 2 | 2 | 7 | 1.7 |

(Number of settling microbes)

As is clear from the Table 5, while the average number of settling microbes per petri dish was 13.5 when the air purification unit 3 was not operated, when the air purification unit 3 was operated for 180 (min), the average number of microbes per petri dish decreased to 1.7.

Thus, it became clear that the air purification unit 3 had fungus eliminating function as well.

Further, a similar result was also found at the position outside of the tested shelf, and it turned out that the area of the air being purified extended to the outside of the cabinet.

FIG. 28(*a*) is the result of the measurement with the environmental monitor 24*a* before the operation of the air purification unit 3.

Also, FIG. 28(*b*) is the result of the measurement with the environmental monitor 24*b* after the operation of the air purification unit 3.

The result of the measurement with the environmental monitors 24*a* and 24*b* indicates that, as shown in FIG. 28(*a*), while a reaction was found in level 1 showing the acid environment before the operation of the air purification unit 3, as shown in FIG. 28(*b*), the environmental cleanliness was improved to around level 2–3 showing the clean environment and the alkaline environment, respectively, after the operation of the air purification unit 3, and acid pollutant was removed. This indicates that the storage section is in the desirable environment as a storing environment of objects.

Incidentally, other than the cabinet 1 of the embodiment, the invention can widely be used, for example, in storages such as an open type display case 100 comprising a display table 101, a support member 102, and a top board 103 as shown in FIG. 29, a movable shelf, a fixed shelf, a showcase, a closet, a shoe box, a storeroom, and a rest room.

Figure 30A:
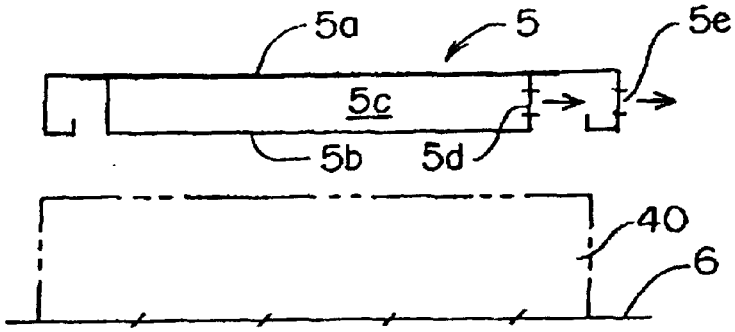
FIG. 30 is a sectional view showing various modifications and exhaust directions of the shelf board combined outlet duct applicable to the present invention.
Figure 30B:
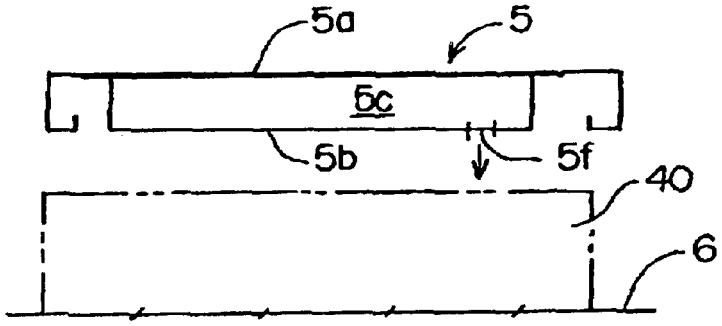
Figure 30C:
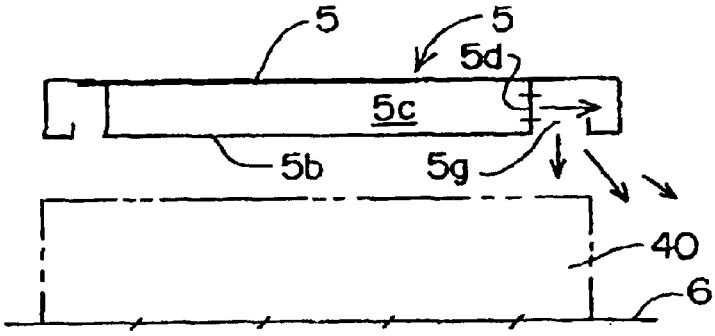
Figure 31:
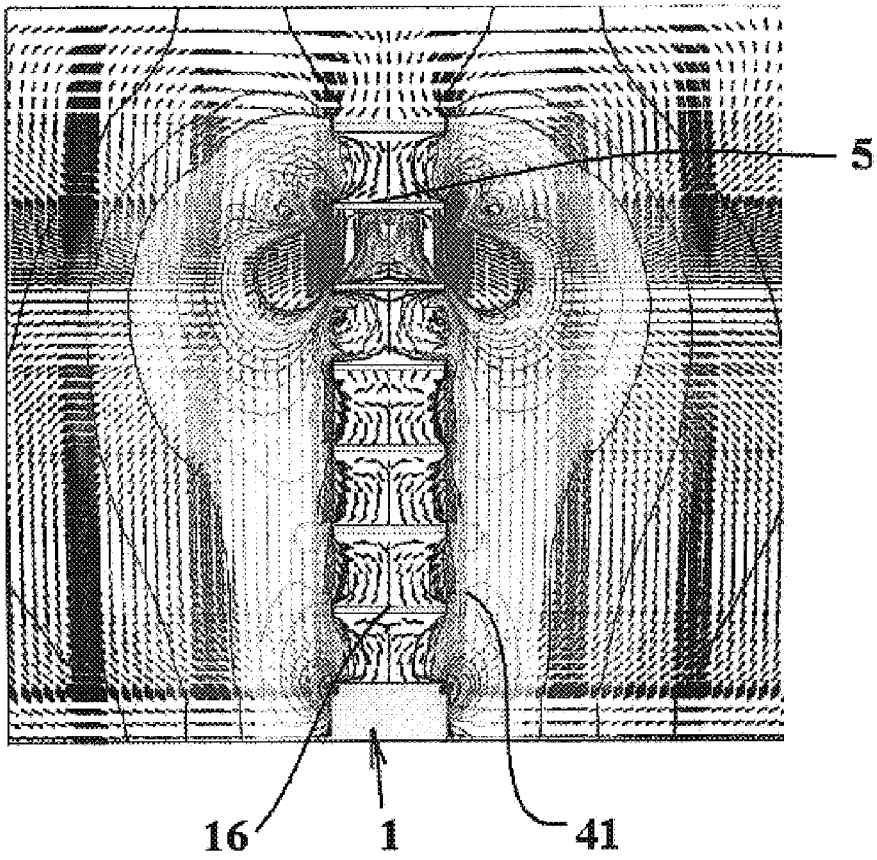
FIG. 31 is a sectional view showing an aspect of the air curtain formed with airflow in an example of the shelf board combined outlet duct shown in FIG. 30(*c*).
Figure 32:
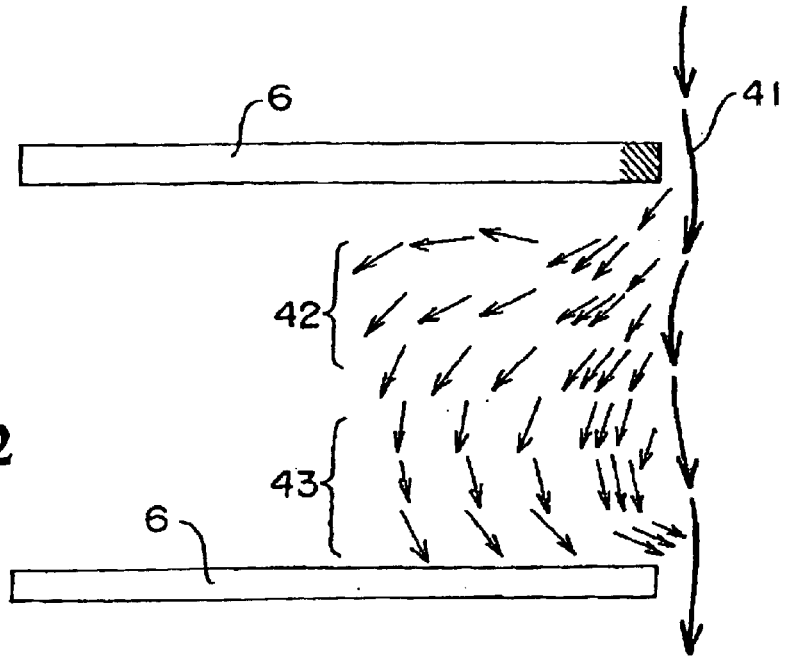
FIG. 32 is a sectional view showing an aspect that air in the storage is induced and circulated by the above air curtain.

The inventors discussed the structure of an outlet port, the difference in the direction of air being exhausted caused by the difference in the structure thereof, and the air circulation and the air purification effects in the storage section caused by the difference in the direction of the air being exhausted and further discussed more desirable structure of the outlet port. FIG. 30 shows by stages the shift of the discussed structure of the outlet port, and FIG. 31 and FIG. 32 show the aspect of an airflow in the desirable structure of the outlet port.

FIG. 30(*a*) is of the same constitution as that of the shelf board combined outlet duct as shown in FIG. 4, arranged such that the clean air sent into the outlet path 5*c* of the shelf board combined outlet duct 5 is exhausted through the outlet port 5*d* formed on the side of the reinforcing board 5*b* forming the outlet path 5*c* in the horizontal direction and then exhausted through an outlet port 5*e* formed on the side of the shelf board material 5*a* (side along the opening on the front side of the cabinet) toward the outside of the cabinet in the horizontal direction. The exhausted air, as explained with reference to FIG. 13 or other, flows so as to wrap the opening of the cabinet in from the outside, and it is sucked through the inlet port, purified with the filter, and then again exhausted through the outlet port 5*e*.

In such a manner as described, if the cabinet has the outlet port structured as illustrated in FIG. 30(*a*), the air curtain is formed around the cabinet, thereby preventing the invasion of fungus spores, harmful insects, or the like from the opening of the storage section and the pollution of the air in the storage section and purifying the air inside and in the proximity of the storage. However, if the outlet port is arranged such that the air is not exhausted in the horizontal direction therethrough but flows linearly toward the inlet port, the air curtain can efficiently be made in a stable fashion, so that the air can efficiently be circulated. That is, when the cabinet has at its upper part the outlet port and at its lower part the inlet port, the outlet port is arranged such that the air is exhausted downwardly therethrough.

Thus, as shown in FIG. 30(*b*), it was arranged such that the clean air sent into the outlet path 5*c* of the shelf board combined outlet duct 5 was exhausted downwardly through an outlet port 5*f* formed underneath the reinforcing board 5*b* forming the outlet path 5*c*. In this arrangement, the desired object can also be achieved. However, it turned out that, when a stored object 40 was placed on the shelf board 6 below the shelf board combined outlet duct 5, the air exhausted downwardly through the outlet port 5*f* directly struck against the stored object 40 at approximately the same flow speed as that in exhausting, so that the stored object 40 was likely to suffer from wind damage.

Thus, next, it was arranged such that, as shown in FIG. 30(*c*), the clean air sent into the outlet path 5*c* of the shelf board combined outlet duct 5 was exhausted in the horizontal direction through the outlet port 5*d* formed on the side of the reinforcing board 5*b* forming the outlet path 5*c* and then struck against the inner side of the shelf board material 5*a* so that its flow in the horizontal direction could temporarily be blocked, and also arranged that a slit-like space 5*g* was formed between the side of the reinforcing board 5*b* and the inner side of the shelf board material 5*a* in the direction of the length of the shelf board material 5*a* (lateral direction when the storage viewed from the front), through which the air was exhausted. Here, the outlet port 5*d* is designated as a first outlet port, and the slit-like space 5*g* is designated as a second outlet port. According to the embodiment shown in FIG. 30(*c*), since the clean air exhausted in the horizontal direction through the outlet port 5*d* strikes against the inner side of the shelf board material 5*a*, and its flow in the horizontal direction is temporarily blocked, the flow speed of the air exhausted through the slit-like space 5*g* as the second outlet port is reduced, and the component of the airflow in the horizontal direction exhausted through the outlet port 5*d* and the component of the airflow heading downward through the space 5*g* are joined together to be exhausted obliquely downwardly toward the outside of the storage.

Thus, according the embodiment shown in FIG. 30(*c*), since the flow speed of the air exhausted through the slit-like space 5*g* is reduced, the wind damage is reduced even if this airflow strikes against the stored object 40. Further, since the air is exhausted obliquely downwardly toward the outside of the storage through the slit-like space 5*g* as the second outlet port, displacement striking against the stored object 40 is reduced, so that the wind damage is reduced in terms thereof.

In any embodiment, the clean air flows so as to wrap the outside of the storage in, and the air inside of the storage also gets caught in this airflow to be circulated. FIG. 31 and FIG. 32 show the result of the analysis by simulation of how the air flows in the embodiment shown in FIG. 30(*c*). In the embodiment shown in FIG. 30(*c*), the air exhausted obliquely downwardly through the slit-like space 5*g* flows downwardly toward the inlet port at the lower part of the storage 1 along the front side (opening) of the storage 1. In FIG. 32, numeral 41 designates an airflow flowing along the front side of the storage 1. Part of the airflow 41 enters the upper space between the upper and lower shelf boards 6 and 6 by the wind pressure of the airflow 41 as shown by numeral 42. In the lower space between the upper and lower shelf boards 6 and 6, the airflow is sucked by the airflow 41 to change its direction as shown by numeral 43, and part of the air between the shelf boards 6 and 6 is carried outside. Thus, the air between the shelf boards 6 and 6 is also induced by the airflow 41 to be circulated, and the air inside of the storage is purified.

Figure 33:
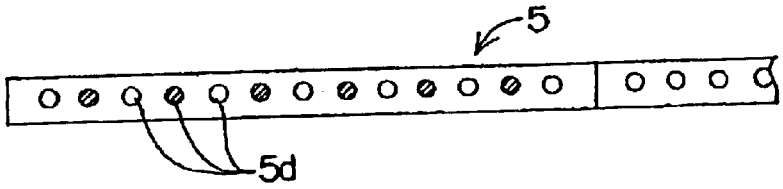
FIG. 33 is a front view showing a modification of the exhaust duct part applicable to the present invention.

The clean air to be exhausted through the exhaust port is desirably exhausted uniformly from the open side of the storage, and, similarly, the air to be sucked through the inlet port is desirably sucked uniformly from the open side of the storage. Thus, in the area where the air volume to be exhausted or sucked tends to be short, measures are preferably taken such as enlarging the area of the outlet or inlet port or increasing the number thereof. FIG. 33 is the shelf board combined outlet duct 5 having the outlet ports 5*d* provided on its side at a certain distance, and some of the outlet ports 5*d* are accordingly clogged in the area where air displacement is large, so that the uniformity of the displacement is effected. The inlet port is preferably arranged in the same manner as described.

Next, another embodiment of the storage with air purification function of the invention will be described below with reference to FIGS. 34 through 36. Although this embodiment is simplified in constitution as compared to the one described above, the desired object can sufficiently be achieved.

Figure 34:
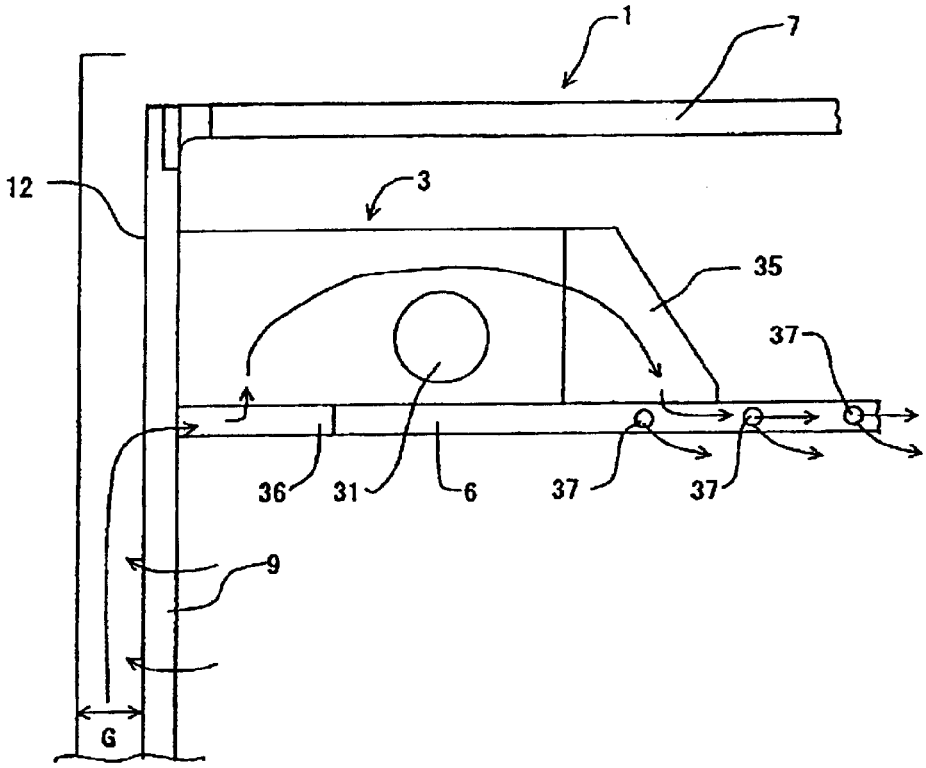
FIG. 34 is a front view showing an enlarged essential part of yet another embodiment of the storage with air purification function related to the present invention.

In FIG. 34, a cabinet 1 is comprised of a support member 9, a top board 7, a shelf board 6, and a side board 12 similarly to the foregoing cabinet. The cabinet may have plurality of or a single shelf board(s) 6. In any case, on the uppermost shelf board 6 is placed an air purification unit 3 as an air purification means adjacent to the side board 12. The air purification unit 3, similarly to the foregoing example, has a dust collection filter, an odor eliminating means, a sirocco fan 31 as an air circulating means, an inlet section and an outlet section. The outlet section is integrally coupled to an outlet path 35.

Since the side board 12 has an interior space of width G between the side board and the outer side of the support member 9, which is utilized as an inlet duct. The side edges of the side board 12, more precisely the side edges when the cabinet 1 viewed from the side, that is, when the side board 12 viewed from its front, are bent toward the cabinet 1 body, and the end edges of these bent portions are fixed to the outer side of the support member 9. Between the end edges of these bent portions and the outer side of the support member 9 forming part of the cabinet 1 body is commonly provided a gap which air can pass therethrough and which interconnects to the inlet duct in the side board 12.

Part of the shelf board 6 constitutes an inlet path interconnecting to the inlet duct in the side board 12, and the inlet path 36 in the shelf board 6 is directly connected to the inlet section of the air purification unit 3. The shelf board 6 also serves as an outlet duct, to which the outlet path 35 is directly connected. As a result, the inlet section of the air purification unit 3 is integrally formed with the outlet path 35 and the outlet duct. The inlet path and the outlet duct formed in the shelf board 6 are defined by a partition board. The appropriate number of outlet ports 37 is formed on the front side of the shelf board 6, and the outlet port 37 interconnects to the outlet duct. The outlet port 37 is formed in the entire frontage direction of the cabinet 1, and the outlet duct formed in the shelf board 6 is correspondingly an elongated outlet duct in the entire frontage direction of the cabinet 1. In an example shown in FIG. 35, a cabinet 1 has three columns, and outlet ports 37 are formed in the entire frontage direction of the shelf boards 6 of three columns, and a corresponding elongated outlet duct is formed.

Thus, according to the embodiment shown in FIG. 34, the cabinet is not provided with any particular inlet port, and an existing gap between the body of the cabinet 1 and the side board 12 is utilized as an inlet port. Further, the purified air exhausted form the air purification unit 3 is arranged to be exhausted from the outlet port 37 of the shelf board 6 through the duct in the shelf board 6 on which the air purification unit 3 is installed. Therefore, this embodiment is simplified in constitution as compared to the one described above. Nevertheless, a test result showed that a desired effect could be obtained. Next, the test result will be described.

Figure 35B:
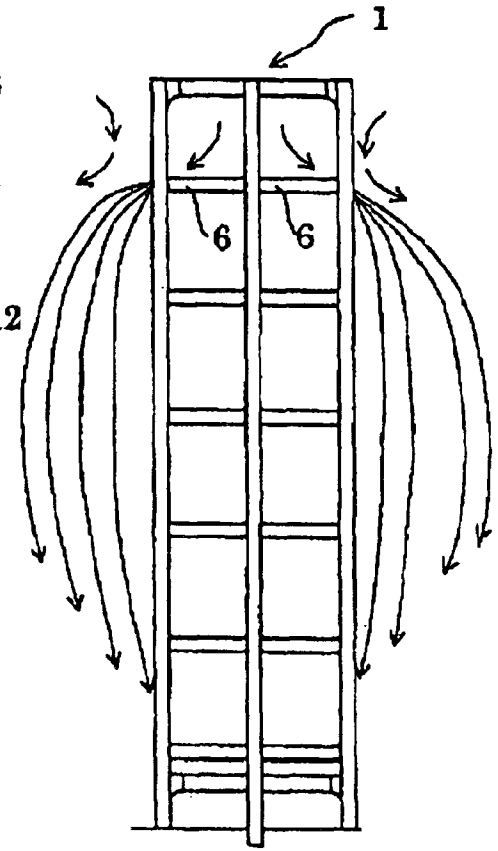
FIG. 35(*a*) is a front view of airflow according to the same embodiment above, and FIG. 35(*b*) is its side view.
Figure 35A:
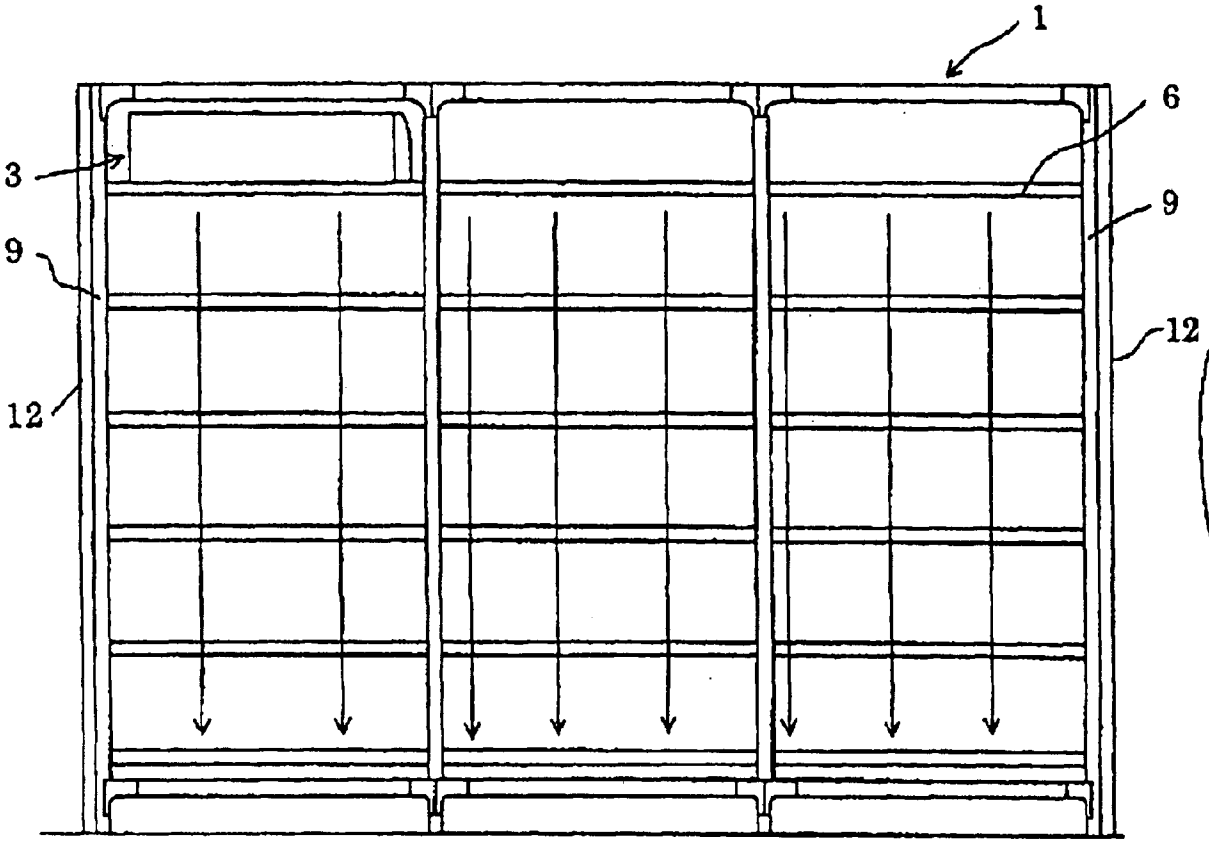
Figure 36B:
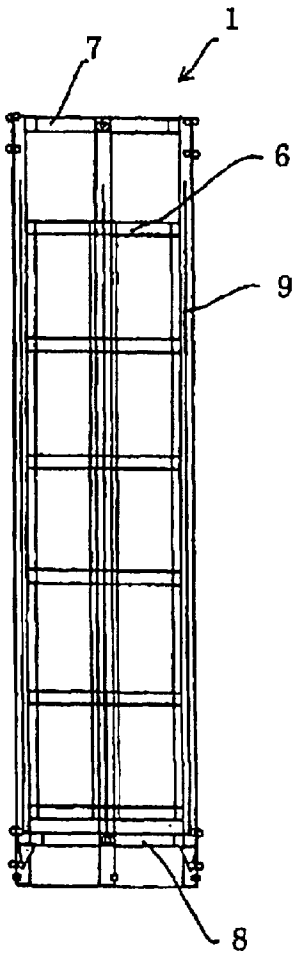
FIG. 36(*a*) is a front view showing a measuring point for evaluating the purification performance of the above embodiment, and FIG. 36(*b*) is its side view.
Figure 36A:
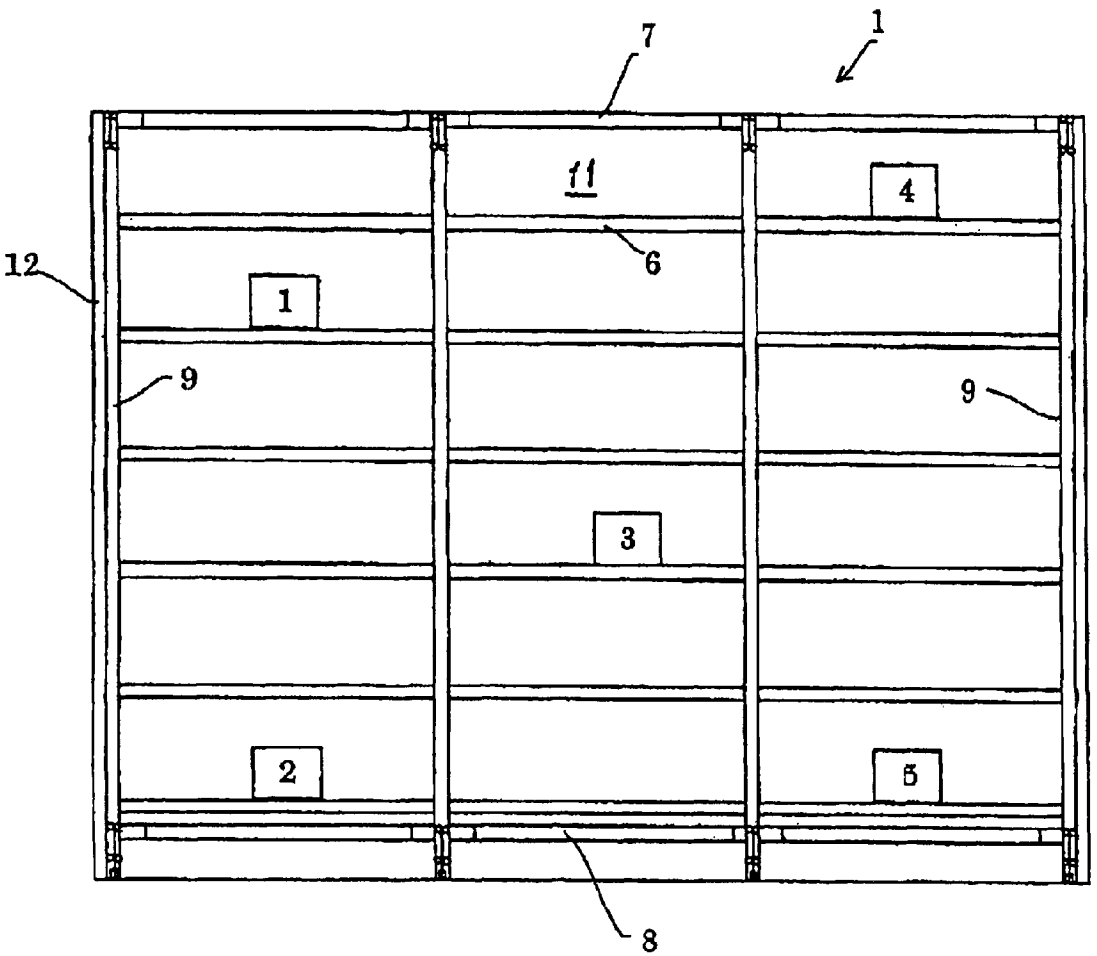

As shown in FIG. 35(*a*), the air purification unit is installed on the uppermost shelf board 6 at its left end, and the purified air is exhausted through the outlet ports of the shelf board 6. The lines with arrows in FIGS. 35(*a*) and 35(*b*) show the result of simulation of the direction of the air exhausted from the outlet ports flowing. As seen from these figures, the purified air flows along the open side of the cabinet 1 while spreading from the upper shelf board 6. It was confirmed that an airflow occurred so as to wrap the open side in though the average wind velocity at the lowermost shelf was around 0.04 m/min of a slight wind. The air which flows along the open side is sucked through the gap between the body of the cabinet 1 and the side board 12 and purified with the air purification unit, and it is purified while being circulated by being exhausted and sucked in such a manner as described.

In order to verify the air purification effect of the storage with air purification function of the embodiment, a settling microbe measurement test was conducted by using an air checker as above. To compare the effects, measurement was made, before the operation and right after the 24 hour operation of the air purification unit 3, between the storage provided with the outlet duct only in the one frontage of the shelf board and the storage provided with the outlet ports in the entire frontages of the shelf boards as shown in FIG. 34, with the air purification unit 3 at the same positions as those shown in FIG. 34 and FIG. 35(*a*) and without any particular inlet port. The storages used for the measurement, as shown in FIG. 35 and FIG. 36, have three columns of the frontages and six shelves of the shelf boards 6. Measurement points are the following five points shown in FIG. 36(*a*) by numerals 1–5 surrounded with squares: on the second shelf board from the top at the left end, on the lowermost shelf board at the left end, on the third shelf board from the bottom in the middle, on the uppermost shelf board at the right end, and on the lowermost shelf board at the right end. Measurement items are molds and bacterium.

Table 6 and Table 7, as an example shown in FIG. 35, indicate measured values with the storage having the outlet duct and ports in the entire frontages of the cabinet 1, showing the results of the measurement before the operation and right after the 24 hour operation of the air purification unit, respectively. Table 8 and Table 9 indicate the measured values with the storage having the outlet duct and ports only in the one frontage of the cabinet 1, showing the results of the measurement before the operation and right after the 24 hour operation of the air purification unit, respectively.

TABLE 6

Before operation

| Installing location | Mold | Bacteria | Total |
|---|---|---|---|
| ① | 4 | 2 | 6 |
| ② | 52 | 11 | 63 |
| ③ | 9 | 4 | 13 |
| ④ | 1 | 1 | 2 |
| ⑤ | 26 | 10 | 36 |
| | | | average: 24 |

TABLE 7

After operation

| Installing location | Mold | Bacteria | Total |
|---|---|---|---|
| ① | 0 | 1 | 1 |
| ② | 7 | 1 | 8 |
| ③ | 4 | 3 | 7 |
| ④ | 1 | 2 | 3 |
| ⑤ | 13 | 3 | 16 |
| | | | average: 7 |

TABLE 8

Before operation

| Installing location | Mold | Bacteria | Total |
|---|---|---|---|
| ① | 16 | 2 | 18 |
| ② | 44 | 2 | 46 |
| ③ | 24 | 6 | 30 |
| ④ | 16 | 1 | 17 |
| ⑤ | 52 | 13 | 65 |
| | | | average: 35.2 |

TABLE 9

After operation

| Installing location | Mold | Bacteria | Total |
|---|---|---|---|
| ① | 19 | 0 | 19 |
| ② | 47 | 1 | 48 |
| ③ | 13 | 0 | 13 |
| ④ | 6 | 1 | 7 |
| ⑤ | 46 | 12 | 58 |
| | | | average: 29 |

As seen from the Table 6 and Table 7, the storage having the inlet and outlet ducts in the entire lateral direction along the open side of the cabinet produced an improvement effect of 71.0% by operating the air purification unit for 24 hours. On the other hand, as seen from the Table 8 and Table 9, the storage having the inlet and outlet ducts in the lateral direction of only the one frontage of the cabinet produced the improvement effect of 17.5% when the air purification unit was operated for 24 hours, and it turned out that the improvement effect was higher by the difference of 53.5 points in the storage having the inlet and outlet ducts in the entire lateral direction along the open side of the cabinet than in the storage having the same in the lateral direction of only the one frontage of the cabinet.

Incidentally, according to the foregoing embodiment in which the inlet and outlet ducts are provided in roughly the entire frontage direction of the storage, the 180 minute operation of the air purification unit had the improvement effect of 87.4%, showing an immediate effect. However, it is sufficient if the storage can gradually be improved in its environment even if it takes time, and it turned out that the cabinet without any particular inlet port as shown in FIG. 34 could also be achieved a satisfactory effect. It further turned out that if the inlet and outlet ducts were provided in roughly the entire frontage direction of the storage, quite a satisfactory effect could be obtained, and also, the storage provided with the outlet ducts and ports within the limited range of only the one frontage could be achieved the satisfactory effect as the operating time of the air purification unit elapsed, even though it did not have the immediate effect.

INDUSTRIAL APPLICABILITY

According to one feature of the invention, purified air is circulated in the storage section of the storage, and the open side of the storage section is covered by the air curtain including the purified air, so that the invasion of particles and harmful insects into the storage section is blocked, and the deterioration of the stored object can be prevented.

Particularly according to another feature of the invention, the circulating air flow flows to cover the opening formed in the front side of the storage, so that the air curtain including the purified air is certainly formed along the opening of the storage. According to yet another feature of the invention, circulating speed of air circulated by the air circulating means is set to 0.5 m/sec or less, so that deterioration or weathering of the stored object from wind damage can be prevented.

According to another feature of the invention, the upper board forming the top of the storage section of the storage serves as the air duct forming the inlet path or the outlet path, so that configuration of the storage can be simplified, and reducing the cost of the storage can be accomplished.

According to another feature of the invention, the lower board forming the bottom of the storage section of the storage serves as the air duct forming the inlet path or the outlet path, so that configuration of the storage can be simplified, and reducing the cost of the storage can be accomplished. Furthermore, the air forming the curtain is sucked into the lower board forming the lower part of the storage section or exhausted from the lower board, so that the opening of the storage section of the storage is certainly covered by the air curtain.

According to another feature of the invention, since the air duct forming the inlet path or the outlet path is disposed between plurality of supports disposed in the vertical direction along the side of the storage section, the air duct can be disposed by using a dead space in the storage.

According to still another feature of the invention, the plurality of supports disposed in the vertical direction along the side of the storage section and formed in a hollow shape serve as the air duct forming the inlet path or the outlet path, the air duct can be disposed by using a dead space in the storage, as well as the configuration of the storage can be simplified, and reducing the cost of the storage can be accomplished.

According to yet another feature of the invention, since the side board forming the side of the storage section and formed in a hollow shape serves as the air duct forming the inlet path or the outlet path, the air duct can be disposed by using a dead space in the storage, as well as the configuration of the storage can be simplified, and reducing the cost of the storage can be accomplished.

According to another feature of the invention, since the shelf board serving as an air duct comprises an outlet opening for exhausing air from the air duct in the horizontal direction, an inner surface for temporarily blocking the air flow exhausted from the outlet openining, and a second outlet openining or exhausing the air blocked at the inner surface downward, the air flow exhausted from the outlet opening is blocked with the inner surface of the shelf board, reduced its speed, and exhausted from the second outlet opening. Even if the airflow hits the stored object, the air flow is reduced its speed, so that the wind damage is reduced. Furthermore, because air flow exhausted from the second outlet opening is angularly downwardly exhausted toward the outside of the storage, displacement striking the stored object is reduced, so that wind damage is reduced in terms of the above.

According to another feature of the invention, since the shelf board serving as an air duct comprises an outlet opening for exhausting air from the air duct in the horizontal direction, an inner surface for temporarily blocking the air flow exhausted from the outlet opening, and a second outlet opening for exhausting the air blocked at the inner surface downward, the air flow exhausted from the outlet opening is blocked with the inner surface of the shelf board, reduced its speed, and exhausted from the second outlet opening. Even if the airflow hits the stored object, the air flow is reduced its speed, so that the wind damage is reduced. Furthermore, because air flow exhausted from the second outlet opening is angularly downwardly exhausted toward the outside of the storage, displacement striking the stored object is reduced, so that wind damage is reduced in terms of the above.

According to still another feature of the invention, an odor of the air in the storage section is removed by the odor eliminating means, so that pollution of air in the storage section can be prevented.

The invention does not require a special inlet opening; however, the air purification effect is still visible in some extent of operation hours on air purification means, so that satisfying working-effect can be obtained for such air purification of this type of the storage.

As another feature of the invention, by allowing the gap between the storage body and the side board to be the inlet opening, the inlet opening does not need to be disposed specially, and the configuration can be simplified.

By integrally forming the outlet path and the duct in the outlet section of the air purification means, allowing the shelf board to be served as the duct and forming the outlet opening in the shelf board, and forming the inlet path with the shelf board as, the configuration can be simplified.

What is claimed is:

1. A storage device having air purification, said storage device comprising a storage area for storing a stored object formed by at least a pair of vertically extending, transversely spaced supports supporting at least two vertically spaced, horizontally extending shelf boards, said supports and said shelf boards defining at at least one vertical side thereof at least one vertically extending access opening for placing the stored object within said storage area upon selected of said shelf boards and for removing the stored object therefrom, at least one of said supports and one of said shelf boards having hollow portions communicating with each other to define an inlet air opening for drawing atmospheric air into said storage device and an outlet path including an outlet air opening for exhausting atmospheric air introduced in said inlet path from said inlet air opening, and an air purification system including at least a device for circulating atmospheric air through the inlet path and the outlet path and an air purification device in the path of the circulated atmospheric air, the circulated air being directed across said access opening to form an air curtain there across.

2. A storage device having air purification as claimed in claim 1, wherein circulating speed of air circulated by the air purification system is set to 0.5 m/sec or less.

3. A storage device having air purification as claimed in claim 1 wherein an uppermost shelf board has a hollow shape the outlet path.

4. A storage device having air purification as claimed in claim 3, wherein the uppermost shelf board has a plurality of spaced outlet openings for exhausting air from said air duct in a horizontal direction, an vertically extending surface in confronting relation to said outlet openings for temporarily blocking the air flow exhausted from said outlet opening, and downwardly toward a horizontally extending second outlet opening for exhausting the air blocked by said inner surface downward across the access opening.

5. A storage device having air purification as claimed in claim 1 wherein said storage device is comprised of plurality of cabinets disposed such that the back sides of said cabinets are placed in back to back with a predetermined gap therebetween, and the air duct forming at least one of the inlet and outlet paths is disposed in said predetermined gap.

6. A storage device having air purification as claimed in claim 1, wherein the air purification device comprises at least an odor eliminating device.

7. A storage device having air purification as set forth in claim 1 wherein, wherein the air purification device is placed in proximity to one of the vertically extending supports and the inlet path communicates with an interior space of said one vertically extending support.

8. A storage device having air purification as claimed in claim 7, wherein a gap formed between the one vertically extending support and the remainder of the storage device forms the inlet air opening.

9. A storage device having air purification as claimed in claim 7, wherein the air purification device comprises an inlet section and an outlet section, and an outlet path and a duct are integrated in said outlet section.

10. A storage device having air purification as claimed in claim 9, wherein the duct is formed in a shelf board upon which a stored object may be placed, the outlet path is directly connected to said shelf board and the outlet opening is formed in said shelf board.

11. A storage device having air purification me claimed in claim 10, wherein the shelf board forms the inlet path.

* * * * *